US010696049B2

(12) United States Patent
Soriani et al.

(10) Patent No.: US 10,696,049 B2
(45) Date of Patent: Jun. 30, 2020

(54) THERMAL INKJET PRINT HEAD AND METHOD OF MANUFACTURING OF A THERMAL INKJET PRINT HEAD

(71) Applicant: SICPA HOLDING SA, Prilly (CH)

(72) Inventors: Pier Luigi Soriani, Zubiena (IT); Alessandro Scardovi, Ivrea (IT)

(73) Assignee: SICPA HOLDING SA, Prilly (CH)

( * ) Notice: Subject to any disclaimer, the term of this patent is extended or adjusted under 35 U.S.C. 154(b) by 3 days.

(21) Appl. No.: 16/302,970

(22) PCT Filed: May 19, 2017

(86) PCT No.: PCT/EP2017/062113
§ 371 (c)(1),
(2) Date: Nov. 19, 2018

(87) PCT Pub. No.: WO2017/198821
PCT Pub. Date: Nov. 23, 2017

(65) Prior Publication Data

US 2019/0176471 A1 Jun. 13, 2019

(30) Foreign Application Priority Data

May 19, 2016 (EP) ..... 16170381

(51) Int. Cl.
*B41J 2/14* (2006.01)
*B41J 2/16* (2006.01)
(Continued)

(52) U.S. Cl.
CPC ..... *B41J 2/1634* (2013.01); *B41J 2/1404* (2013.01); *B41J 2/145* (2013.01); *B41J 2/14072* (2013.01);
(Continued)

(58) Field of Classification Search
CPC ..... B41J 2/1634; B41J 2/155; B41J 2/1603; B41J 2/15; B41J 2/145; B41J 2/1632;
(Continued)

(56) References Cited

U.S. PATENT DOCUMENTS 6,024,440 A 2/2000 Murthy et al.
6,042,222 A 3/2000 Moritz, III et al.
(Continued)

FOREIGN PATENT DOCUMENTS

CN 1290212 4/2001
WO 2011126492 10/2011

OTHER PUBLICATIONS

H. Schaedel, "A Theoretical Investigation of fluidic transmission with rectangular cross section", Third Cranfield Fluidics Conference, May 1968 Turin, 21 pages.
(Continued)

*Primary Examiner* — Henok D Legesse
(74) *Attorney, Agent, or Firm* — Muncy, Geissler, Olds & Lowe, P.C.

(57) ABSTRACT

The present invention relates to a thermal inkjet print head, comprising a fluid feed channel for delivering fluid, fluid chambers arranged near the fluid feed channel, resistors for actuating the fluid in the chambers, arranged in a staggered pattern with respect to vertical printing lines. At least a part of the fluid feed channel opposite of a rear side of the print head extends substantially orthogonal to the chip surface, and the fluid channel having staggered edges follows the staggered pattern of the resistors so that a fluid path length between a resistor edge and a corresponding staggered edge is substantially similar for each resistor.

6 Claims, 22 Drawing Sheets

(51) Int. Cl.
*B41J 2/155* (2006.01)
*B41J 2/15* (2006.01)
*B41J 2/145* (2006.01)

(52) U.S. Cl.
CPC ..... *B41J 2/14145* (2013.01); *B41J 2/15* (2013.01); *B41J 2/155* (2013.01); *B41J 2/1601* (2013.01); *B41J 2/1603* (2013.01); *B41J 2/1632* (2013.01)

(58) Field of Classification Search
CPC .. B41J 2/1404; B41J 2/14145; B41J 2/14072; B41J 2/1601
See application file for complete search history.

(56) References Cited

U.S. PATENT DOCUMENTS 6,565,195 B2 5/2003 Blair
7,427,125 B2 9/2008 Bengali
8,714,710 B2 5/2014 Rivas et al.
2003/0095166 A1* 5/2003 Tan ..... B41J 2/14145 347/63
2006/0146092 A1* 7/2006 Barnes ..... B41J 2/14024 347/54
2006/0218789 A1 10/2006 Goin et al.
2006/0232636 A1 10/2006 Bengali
2008/0100669 A1 5/2008 Ciere et al.
2008/0316277 A1 12/2008 Edelen et al.
2013/0033548 A1* 2/2013 Rivas ..... B41J 2/1404 347/61
2018/0312971 A1* 11/2018 Fukumoto ..... B41J 2/1629

OTHER PUBLICATIONS

International Search Report and Written Opinion issued with respect to application No. PCT/EP2017/062113, 14 pages.
International Preliminary Report on Patentability issued with respect to application No. PCT/EP2017/062113, 7 pages.
Chinese Office Action in counterpart Chinese Application No. 201780029946.2 dated Jan. 3, 2020 (and English language translation of the Office Action).

* cited by examiner

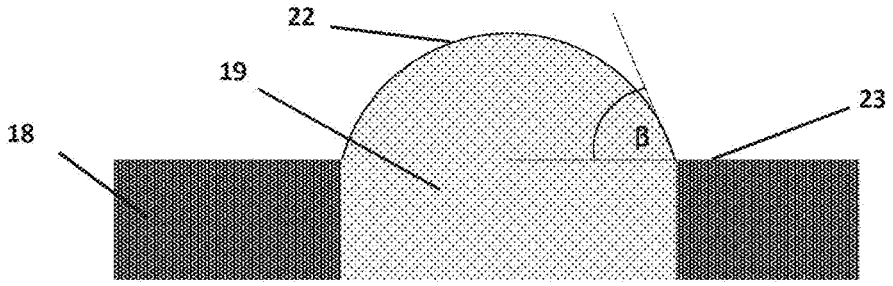
Figure 10
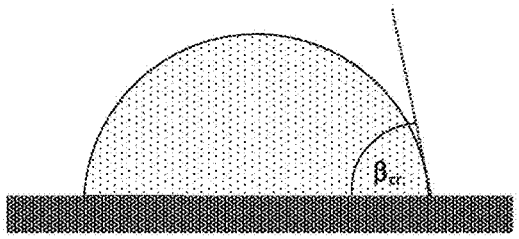
Figure 11a $\beta_{cr.}$
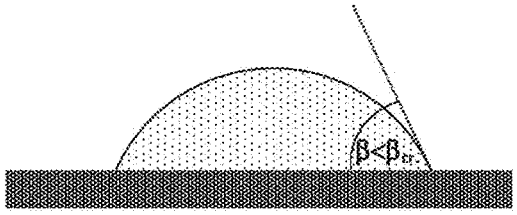
Figure 11b $\beta<\beta_{cr.}$

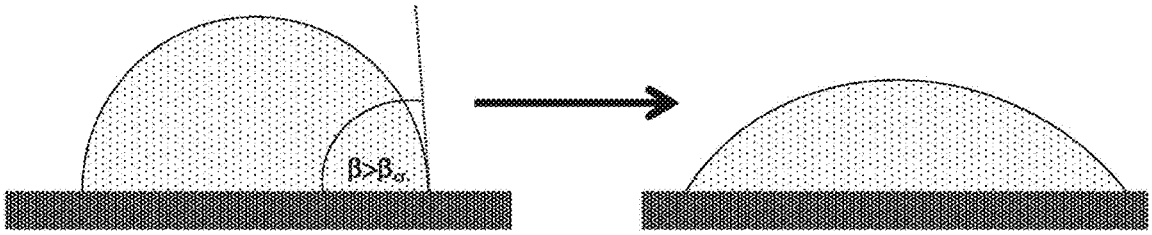
Figure 11c $\beta>\beta_{cr}$
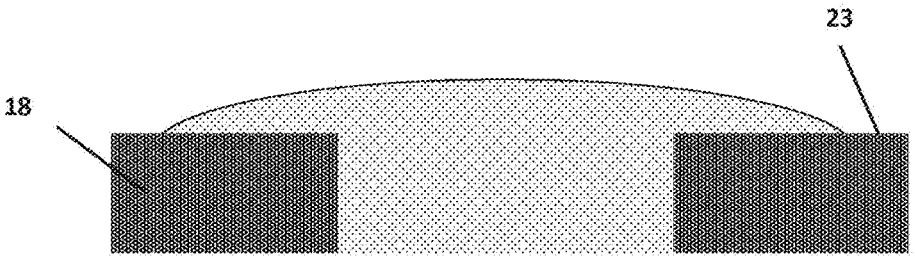
Figure 12

THERMAL INKJET PRINT HEAD AND METHOD OF MANUFACTURING OF A THERMAL INKJET PRINT HEAD

TECHNICAL FIELD

The present invention relates to a thermal inkjet print head and a method for manufacturing same. More specifically, the present invention relates to a print head showing high performance unity.

BACKGROUND OF THE INVENTION

In many types of thermal inkjet print heads the ink is fed from the reservoir to the ejection chambers through one or more slots made longitudinally in the inner part of the substrate, which is often a silicon chip. The ink flows from the rear substrate surface to the front surface, where the electronic as well as the microfluidic circuitries are realized. A single slot can feed one or two heater columns, which stay along the slot edges in the direction of the longitudinal chip axis.

Usually conductive, resistive, dielectric and protective thin films are deposed and patterned, to realize the circuitry. Possible devices like transistors, diodes, memories, etc. can be integrated in the circuitry using the semiconducting properties of the silicon.

The heaters are arranged in a plurality of longitudinal columns, which are adjacent to a through-slot, which is necessary for the ink feeding towards the ejection sites. It is possible to have either a single slot feeding two columns or several parallel slots feeding a corresponding number of column pairs.

So for example a polymeric layer is deposed onto the surface of the silicon chip and patterned to create the ejection chamber around each heater and the channels for the feeding with the ink flowing from the slot. Since the walls of the patterned profile act as an ink containing barrier, the polymeric layer is called «barrier layer».

A nozzle plate is assembled on the top of the barrier layer. It constitutes the ceiling of the ejection chamber and houses a plurality of nozzles, in one-to-one correspondence with the plurality of heaters. Therefore, also the nozzles are arranged in columnar arrays.

The structure created by the ink feeding slot, silicon chip, surface and ejection chambers and nozzles constitute the fluidic circuit of the print head.

In digital printing the ink is distributed onto the medium as a matrix array of dots arranged in rows and columns. The rows extend in the direction of the relative movement between print head and medium. The reciprocal of the distance between contiguous dots in a horizontal line (row) is the horizontal resolution. The reciprocal of the distance between contiguous dots in a vertical line (column) is the vertical resolution.

The vertical resolution is substantially depending on the distance between nozzles in the print head columns. The horizontal resolution is determined by the combination of the ejection repetition rate with the relative movement speed.

The growth of the ink bubble in a thermal print head is caused by a short current pulse applied to the heating resistor. A standard thermal print head has normally hundreds nozzles (up to more than one thousand). If all the nozzles would be activated at the same time, the total current flowing in the circuit would reach an excessive intensity (tens of Ampère). Such a high current level could damage the circuitry of the silicon chip, would require a very huge and expensive power supply in the printing station and the resulting noise might be troublesome.

To solve this issue it is necessary to avoid the general overlapping of the current pulses, i.e. only a subset of nozzles should be allowed to eject a drop at the same time. Therefore the plurality of nozzles in the print head can be divided in several subsets or «firing groups». For each group all the nozzles can be fired at the same time, the different groups are fired in sequence, with a programmed delay between one group and the next one.

In this way, the current pulses for activating all the print head nozzles are distributed in a larger time interval; the maximum current intensity in the device turns out to be equal to the current of a single heater multiplied by the number of heaters belonging to the same firing group.

Since the print head is moving with respect to the medium, it is necessary to stagger the different firing groups along the relative movement direction, according to their own activation timing.

Therefore, the plurality of nozzles in a column cannot be aligned with the vertical printing lines, because they are not activated together.

In FIG. 19 one possibility is shown for inclined linear column segments (blocks), vertically stacked; the nozzles belonging to the same firing group overlap the same vertical printing line.

As can be seen in FIG. 19, the slot profile is substantially a straight line and therefore the staggered heaters turn out to have different distances from the slot edge, depending on their own activation timing. Therefore the fluidic circuit of the nearest heater is shorter than the one of the most distant heater. The difference in the channel length gives a different fluidic behavior. The nearest heater turns out to be also the faster as it has the shortest refilling time, giving the maximum printing frequency. Due to the longer ink path, the rest of the heaters have a longer refilling time, depending on the distance from the slot, and thus they show a lower frequency. This spread limits the print head frequency to frequency of the slowest heater.

To compensate for this spread in the fluidic behavior of the ejection sites, suitable adjustments in the fluidic layout are necessary for each heater.

Document U.S. Pat. No. 8,714,710B2 suggests to produce a substantially equal path length for the fluid flowing from the feed channel towards the staggered resistors. This is achieved by a cantilever, which extends over the fluid channel. This is achieved by a thin film, which is removed in the central part leaving only the cantilever, followed by the completion of the process by removal of the silicon from the backside using laser and/or dry/wet etch. To realize a cantilever extending over the fluid channel, as described, soft etching methods are required on both wafer sides. This kind of process is suitable for a monolithic print head, where all the layers (including the nozzle plate) and all the holes or cavities are made through photolithographic processes.

U.S. Pat. No. 7,427,125 B1 suggests a wet etch process as a final step to complete to form a feed channel which adapts to the zigzag profile of the arranged resistors. By the wet etch process angled sidewalls are achieved. This wet etch process requires hard masks, which cannot be deposited onto e.g. the polymeric layer. Even if wet etching takes place only on the wafer backside, the resulting wall angle wouldn't fit with a layout with parallel slots, close to each other.

PROBLEMS TO BE SOLVED BY THE PRESENT INVENTION

The present invention aims at designing an ink feeding slot in a thermal print head that can solve the issues due to the spread of the distances of the heating resistors with respect to the longitudinal axis of the substrate in a cost- and work-efficient manner.

Further, the present invention aims to design a suitable slot shape and develop an appropriate manufacturing process for it, in order to achieve the substantial equalization of the flow path length between the slot edge and the heating resistors.

It is an object of the present invention to provide a system and method addressing these needs and solving the drawbacks from the prior arts.

SUMMARY

The above mentioned problems and drawbacks of the conventional concepts are solved by the subject-matter of the embodiments of the present invention.

DETAILED DESCRIPTION

According to one aspect, the invention suggests a thermal inkjet print head, comprising a fluid feed channel for delivering fluid, fluid chambers arranged near the fluid feed channel, resistors for actuating the fluid in the chambers, arranged in a staggered pattern with respect to vertical printing lines. In the print head at least a part of the fluid feed channel opposite of a rear side of the print head extends substantially orthogonal to a chip surface, and the fluid channel has staggered edges that follow the staggered pattern of the resistors so that a fluid path length between a resistor edge and a corresponding staggered edge is substantially similar for each resistor.

The feed channel extends substantially orthogonal to the chip surface over the entire length, if it is e.g. is fully laser machined. If it is e.g. made with a mixed process (sand blasting+laser) at least the laser machined portion is substantially orthogonal. The methods are further described below.

The present invention has been made to achieve a higher operating frequency of the print head by maintaining all the operating conditions unaffected.

In a preferred embodiment of the invention the staggered pattern and therefore also the fluid channel are saw-tooth shaped.

According to another aspect, the invention relates to a method for manufacturing a thermal inkjet print head comprising the steps of providing resistors onto a substrate according to a staggered pattern, forming a fluid feed channel through the substrate so that the channel extends substantially orthogonal to the chip surface and having staggered edges that follow the staggered pattern of the resistors so that a fluid path length between a resistor edge and a corresponding staggered edge is substantially similar for each resistor. Hereby the fluid feed channel is formed by a method comprising laser ablation. In a preferred embodiment the method may comprise sandblasting starting from the rear side of the substrate without reaching the opposite surface, and subsequent laser ablation to a through-slot.

Therefore with a method according to the invention it is possible to produce a saw-tooth profile of the fluid channel with nearly straight walls at least in the portion of the wafer thickness which has been laser ablated from the rear side to the front side of the wafer. Neither a cantilever nor an hard mask are necessary.

The invented solution allows manufacture a print head with better performances and higher stability in the drop ejection.

The idea is to develop a manufacturing process able to machine a slot in the substrate such that the slot edge follows substantially the heater distribution along the array. In this way, the distance between slot and resistors is nearly the same for the whole heater array so that the fluidic parameters turn out to be equalized, increasing the maximum operating frequency of the device and improving the printing uniformity.

This solution allows to achieve a higher uniformity in the print head performance and, moreover, it renders easier the design of the microfluidic circuit.

According to a preferred embodiment the laser ablation is applied on the opposite surface.

Preferably the laser ablation is performed on the perimeter. This process can be particularly advantageous when machining very thin substrates It is also possible that the laser ablation is performed on the entire slot surface. This preferred embodiment might help to prevent the obstruction of the narrow kerf from the debris A full ablation of the internal area might in some instances be faster than the cyclic contouring of the perimeter.

Further laser ablation may be performed on an enlarged perimeter. Instead of insisting on a single perimeter line, the ablation is carried out over a larger stripe, which has the perimeter as outer boundary. Using this method, it is not necessary to ablate the total internal area of the slot, but just a smaller boundary stripe. On the other side, the material removal is more efficient, because the ablation is not limited to a narrow kerf and the possibly re-deposed debris cannot cover the whole stripe area.

Good results can be achieved if the laser ablation is performed by alternating movements of the laser beam clockwise and counterclockwise. Such an embodiment may lead to a better accuracy of the machined features, compensating possible errors in the laser spot position due to the scanning head.

DEFINITIONS

For the purposes of the present invention, the term "substantially orthogonal" means not necessarily strictly orthogonal. A laser ablation (but also sand blasting and other drilling or etching methods) through a plate produces holes (or slots) having a certain tapering angle. In some parts of the cases, the cross section at the laser entry side is larger than the one at the exit side. It means that the slot width at the entry side, which is on the rear side of the wafer, is slightly larger than the exit width at the device side. The ratio between the width difference and the wafer thickness is preferably in the range 0.5% to 10%. The tapering is probably due to a mix of optical effects and debris shielding. This should be considered as "substantially orthogonal" according to the invention. The sand blasting, on the contrary, tends to produce a more marked tapering. In FIG. 5, which is a general description of the device, the slot looks tapered. Also this should be understood as "substantially orthogonal2 according to the invention.

The "staggered pattern" according to this description describes that in a column the nozzles are not distributed strictly along a straight line. There is a displacement of each nozzle (and each resistor) in the direction of the relative movement between the print head and the medium (i.e. orthogonal to the nozzle column) which is intentionally realized in the nozzle layout (or pattern), to allow the ink ejection at different times, avoiding the excessive current peak in the circuitry.

Further "substantially similar" according to the present invention means that the slot is shaped in such a way that the distance between the center of a heater and the slot edge are similar. The FIGS. 19 and 21 give a good idea of the meaning.

"Sandblasting" or sand blasting is a widely used process to realize through slots in a print head chip. A suitable equipment sends through a nozzle a thin jet of high pressure air containing small particle of an abrasive material (e.g. alumina grains, silica grains, etc.). The impact of the abrasive particles against the silicon surface of the chip destroys gradually the material, until the exit surface is reached.

"Rear side" according to the description is referred to the wafer backside surface. The print head circuitry is realized at the other, opposite side, which is the front side or the device side. Sand blasting should start starts from the rear side of the wafer inter alia to reduce the possible device damage due to skew particles hitting the front surface. Also the laser ablation starts from the rear side.

"Laser ablation" Is a process where a (usually) focused laser beam hits a substrate and removes parts of the material. By moving the beam with respect to the substrate, a geometrical ablation pattern can be obtained.

"Through-slot" or throu-slot is used in this description for a hole in form of a slot which crosses completely the wafer (or chip) thickness, bringing in fluidic communication the rear side and the front side surfaces of the silicon chip.

The term "perimeter" should describe the geometrical outer profile of the slot. It is preferably a a closed line.

The "enlarged perimeter" should describe a wider area, limited by the outer profile and extending inwards for a certain length. It is a closed stripe instead of a closed line (see e.g. FIG. 30).

SHORT DESCRIPTION OF THE DRAWINGS

The present invention will be described for the sake of better understanding by way of exemplary embodiments. These embodiments may be best understood by taking the following drawings in consideration. In these Figures, FIG. 1 shows a thermal ink print head;

Figure 8:
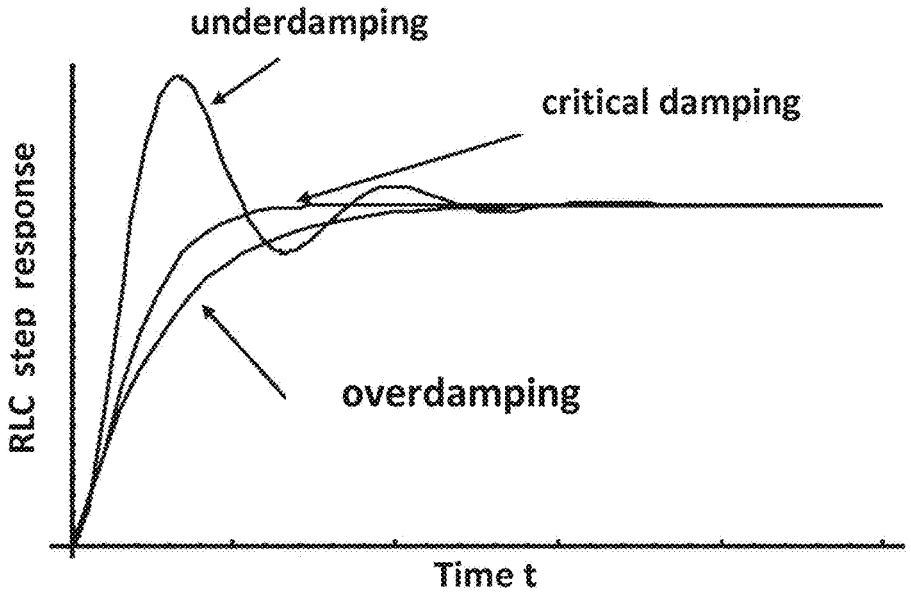
Figure 9:
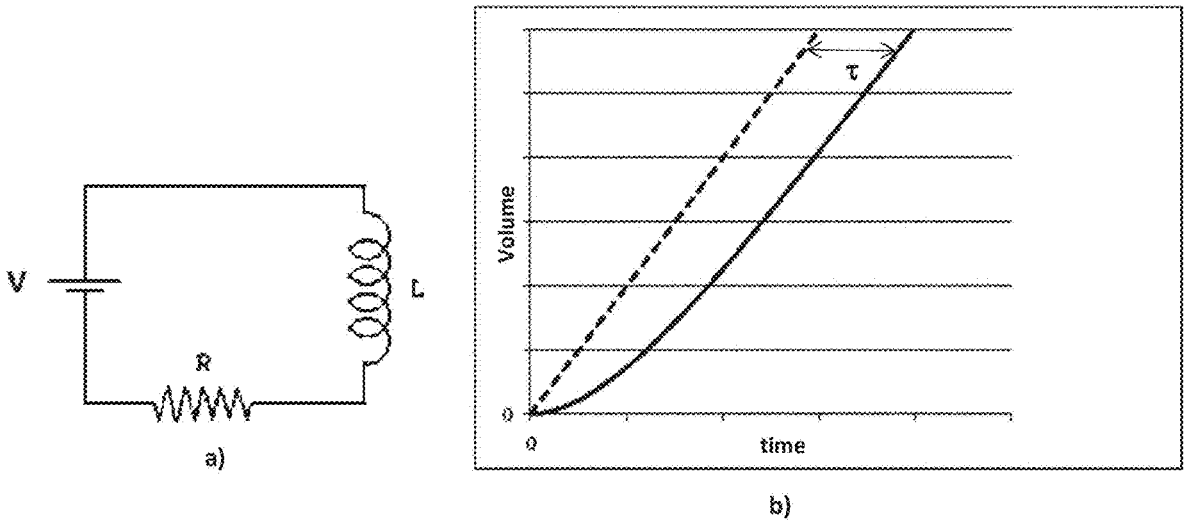
Figure 13A:
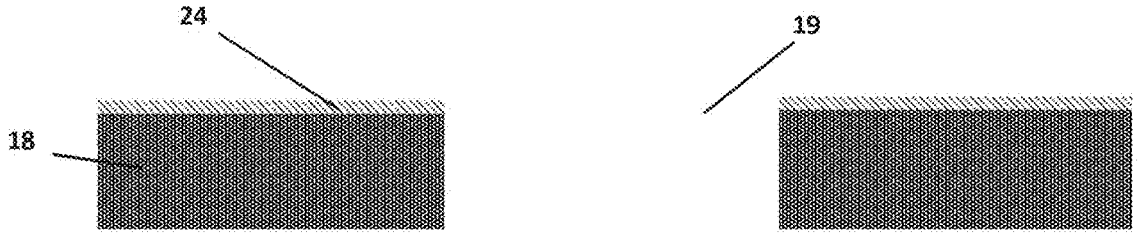
Figure 13B:
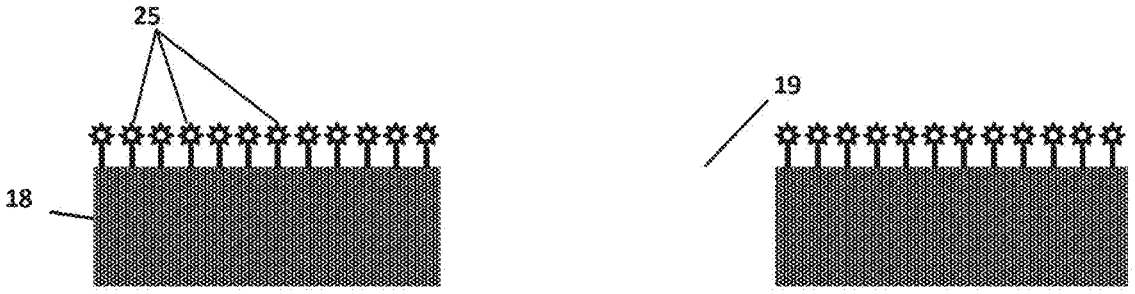
Figure 14:
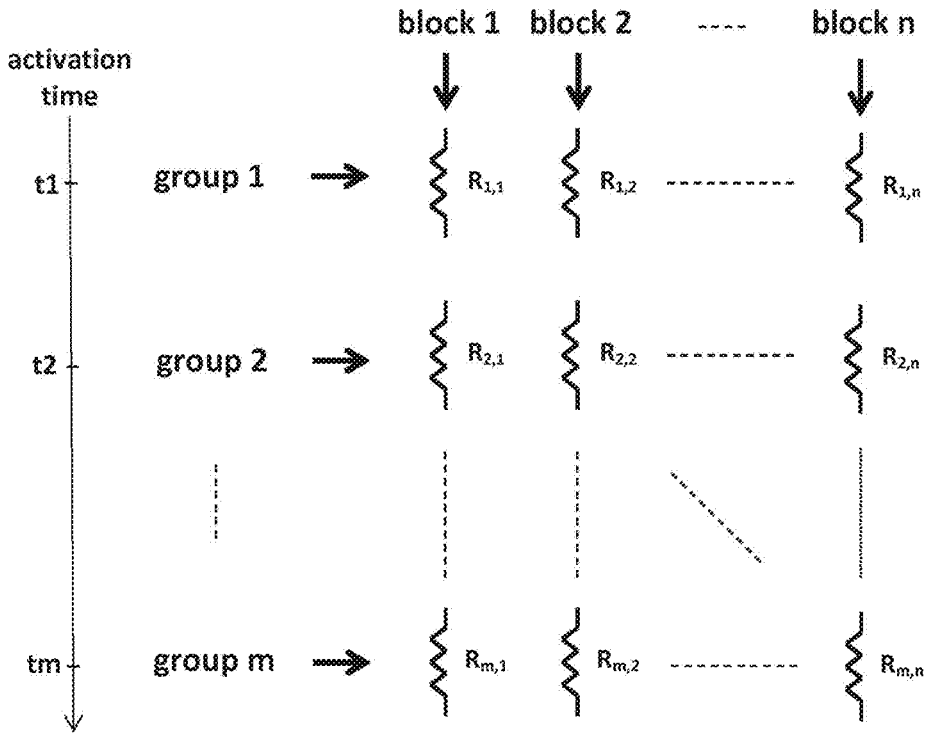
Figure 15:
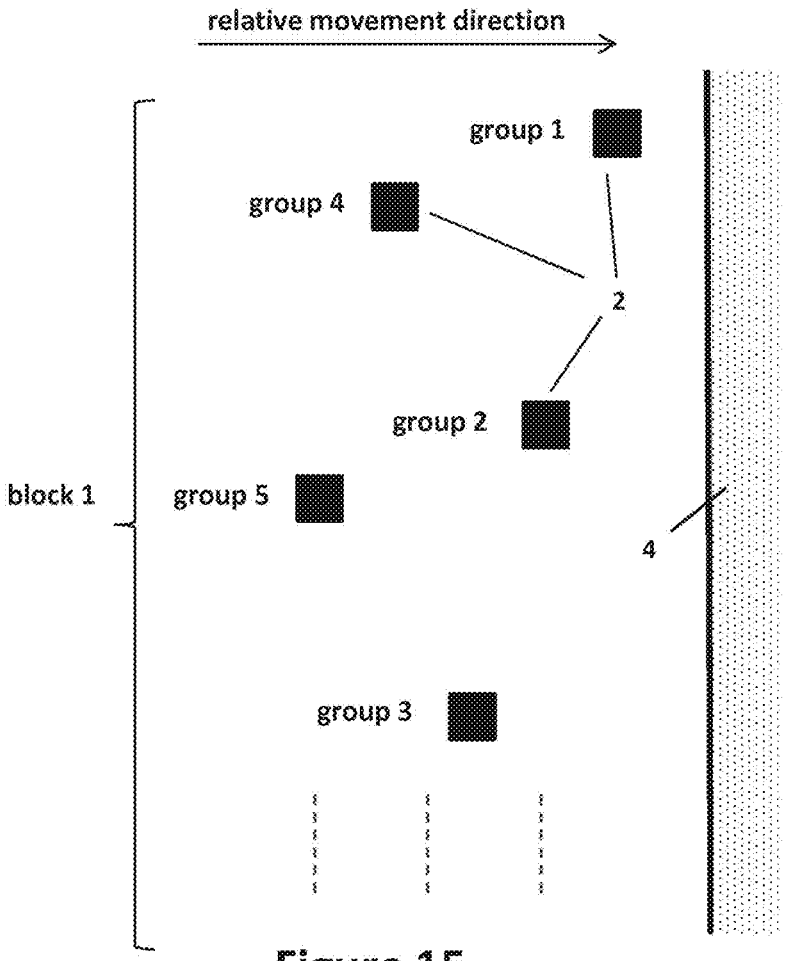
Figure 16:
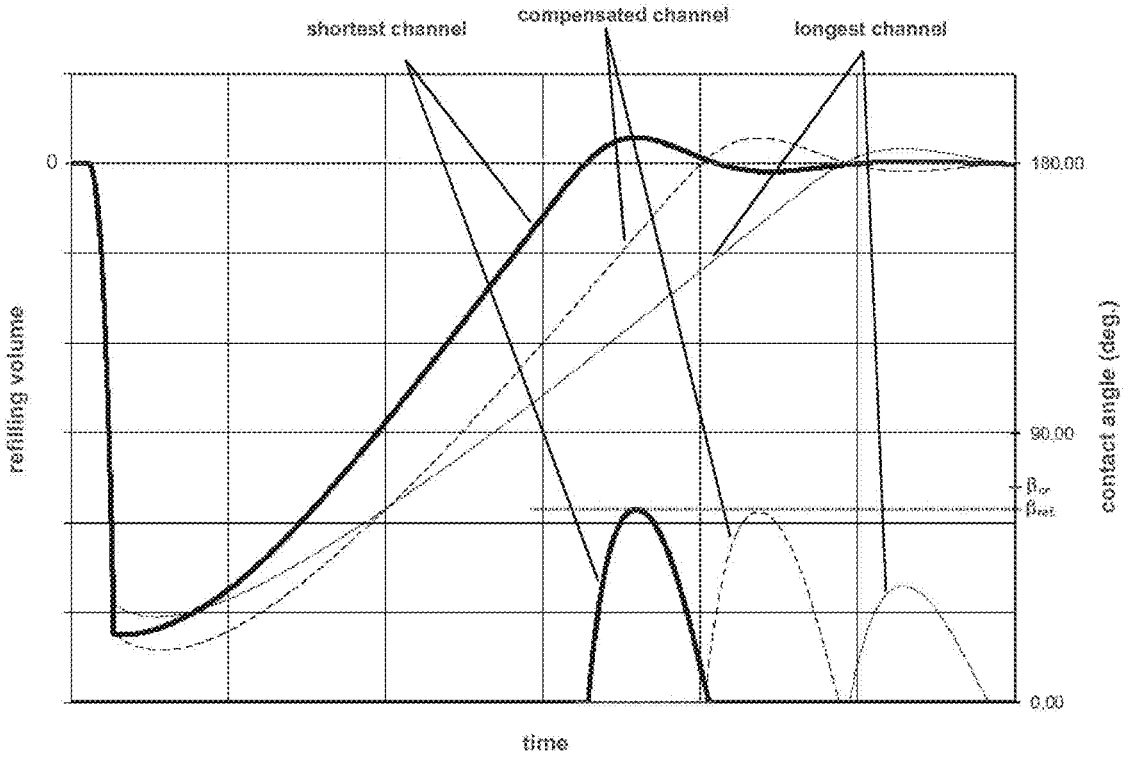
Figure 17A:
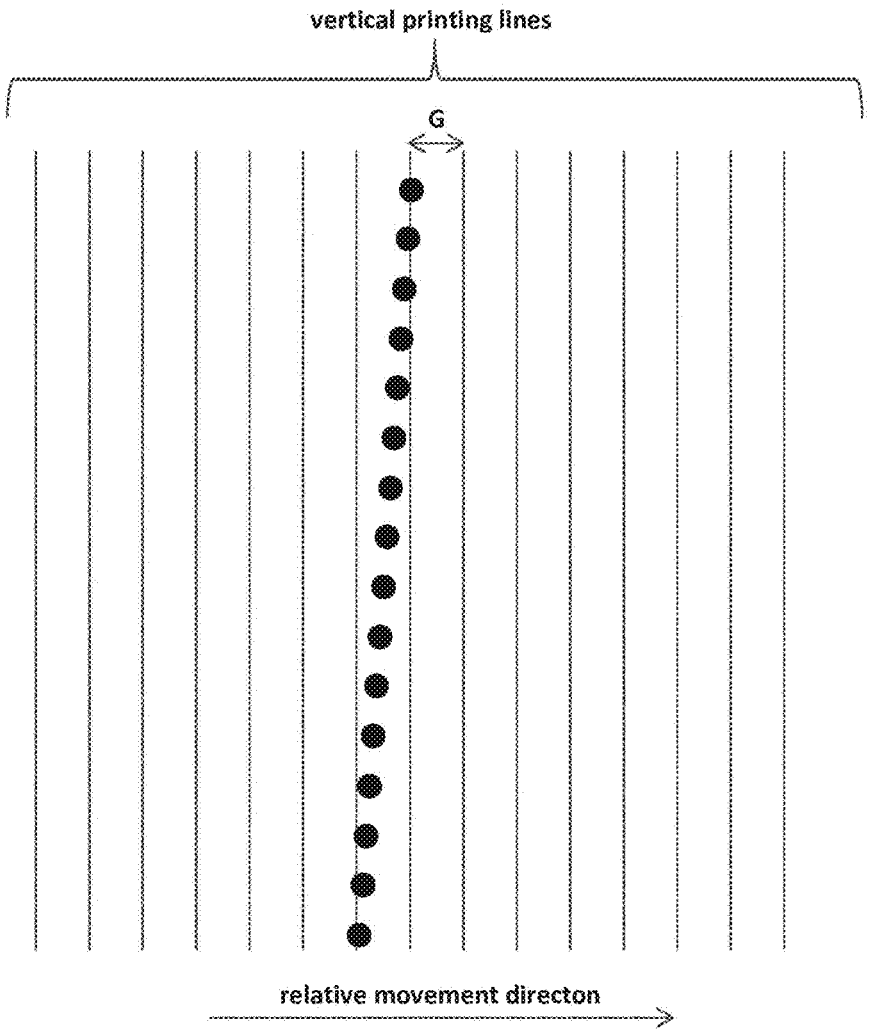
Figure 17B:
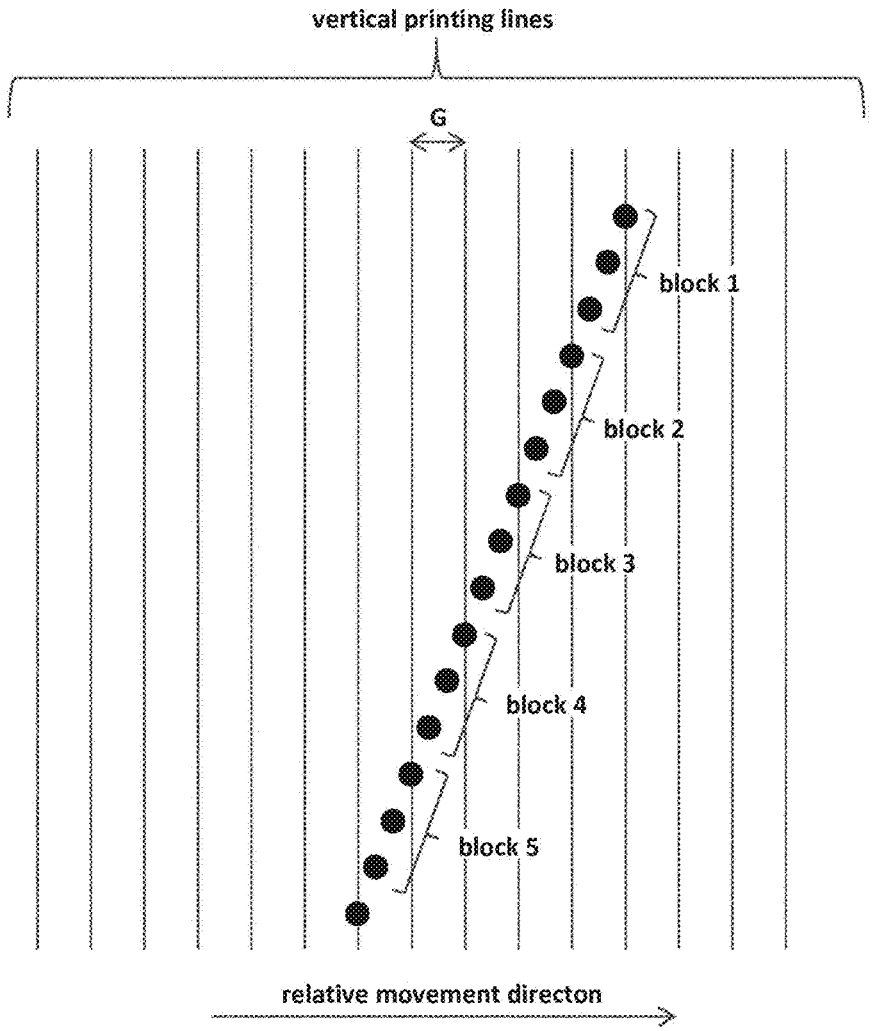
Figure 18:
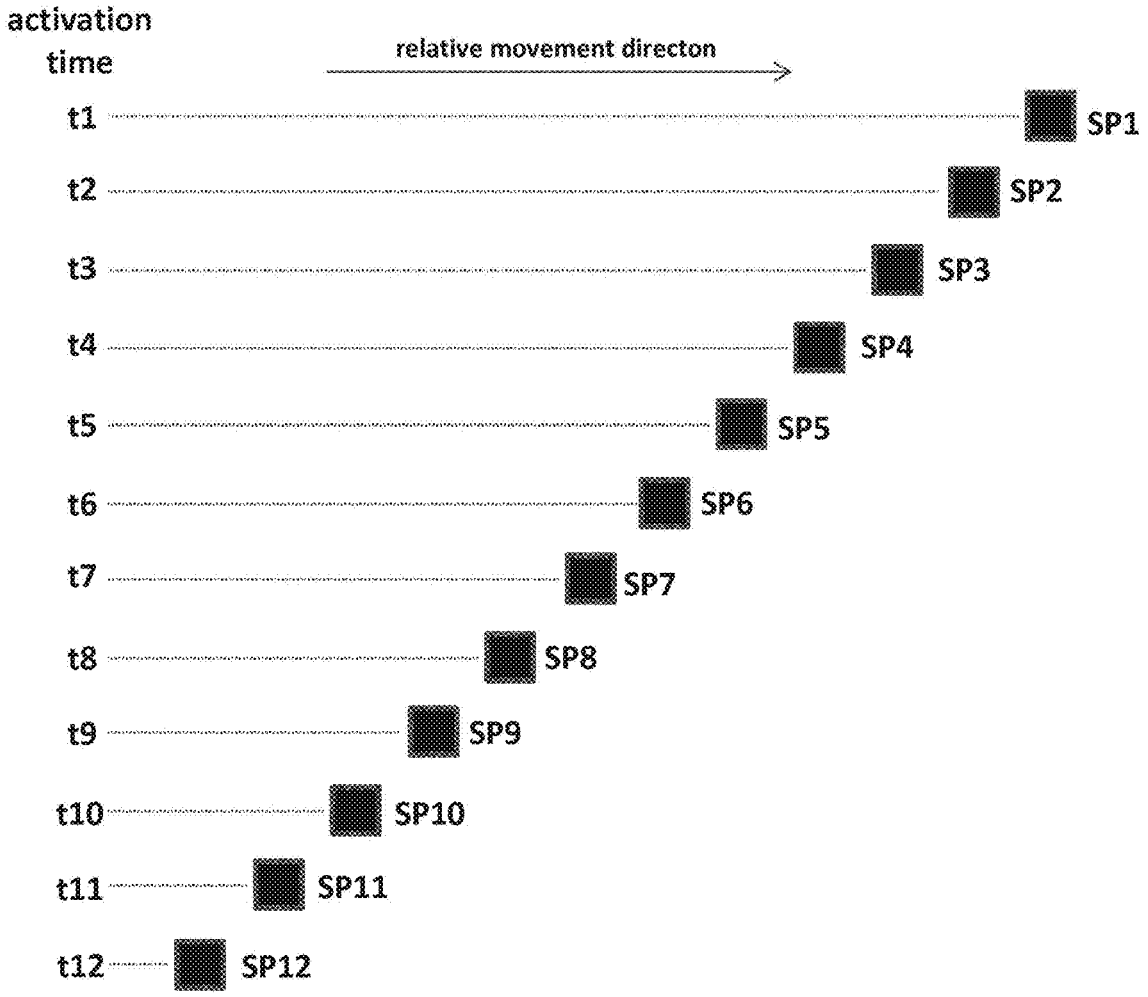
Figure 19:
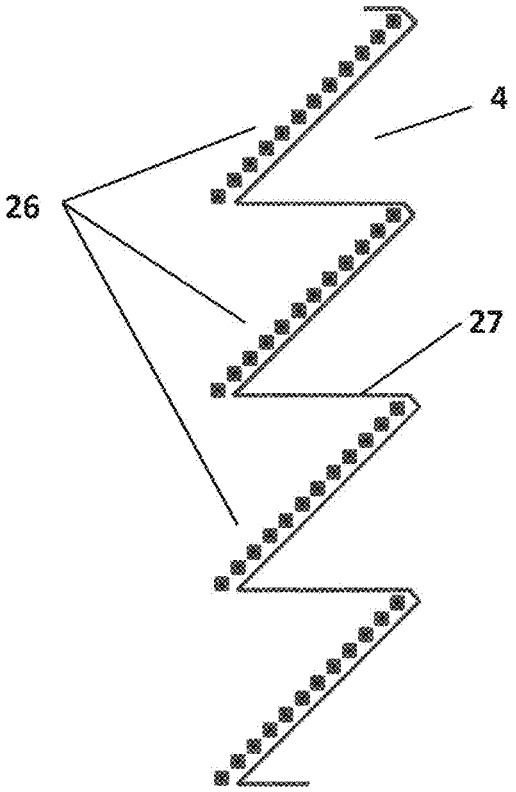
Figure 20:
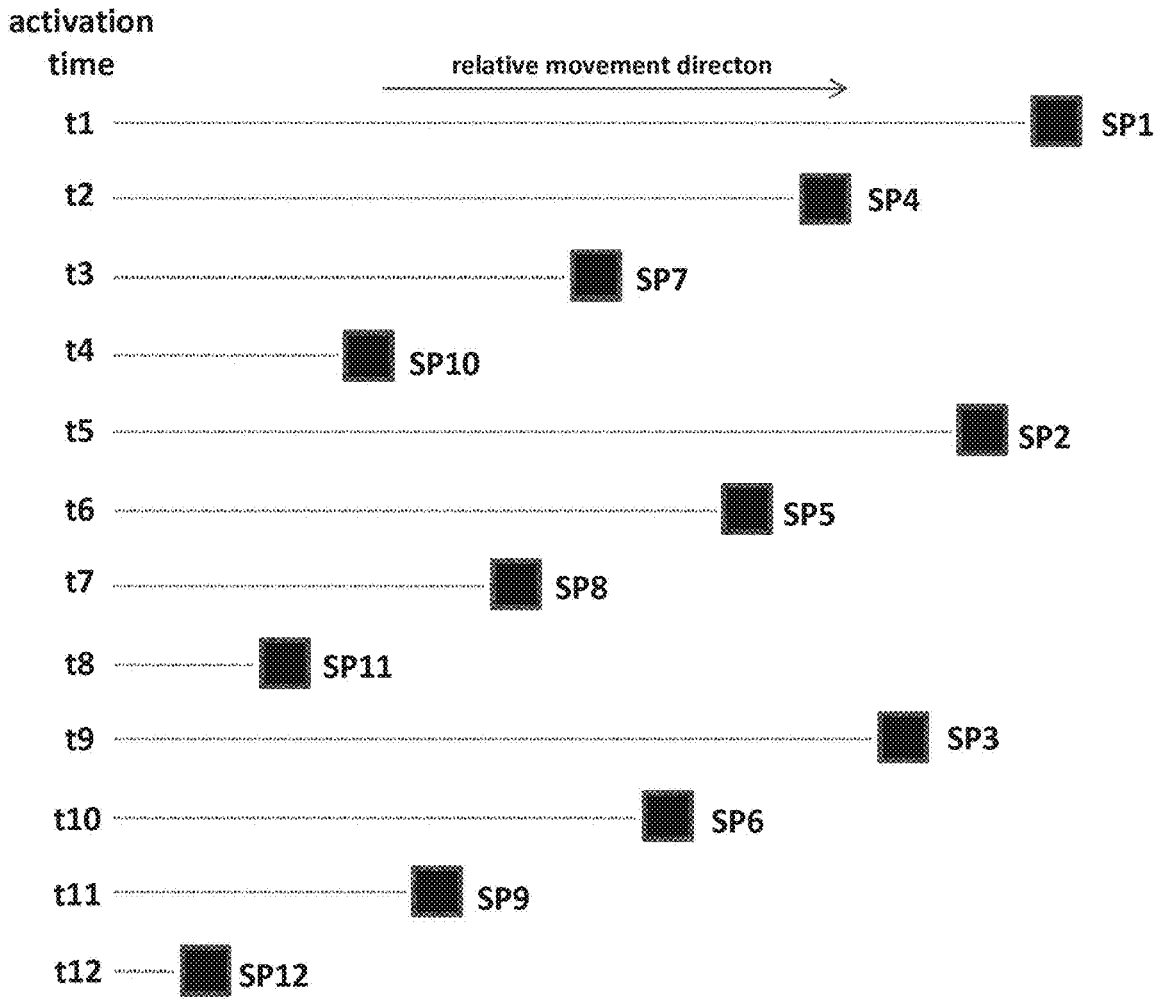
Figure 21:
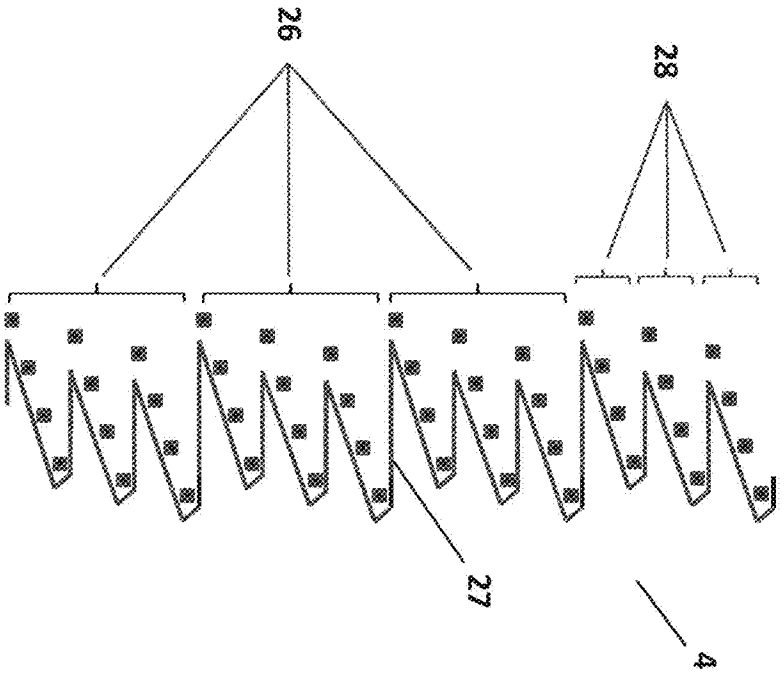
Figure 22:
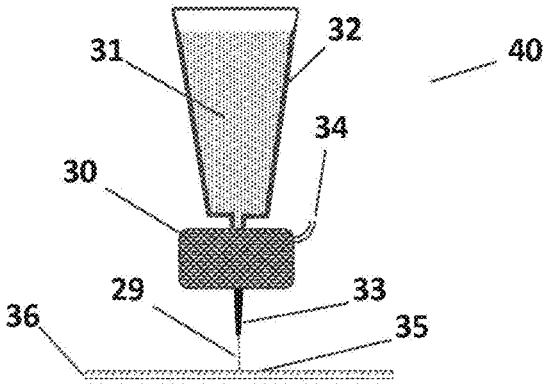
Figure 23:
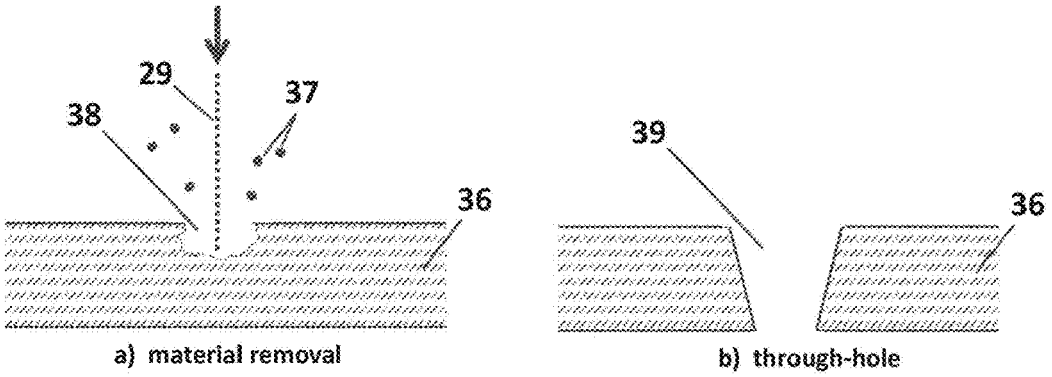
Figure 24:
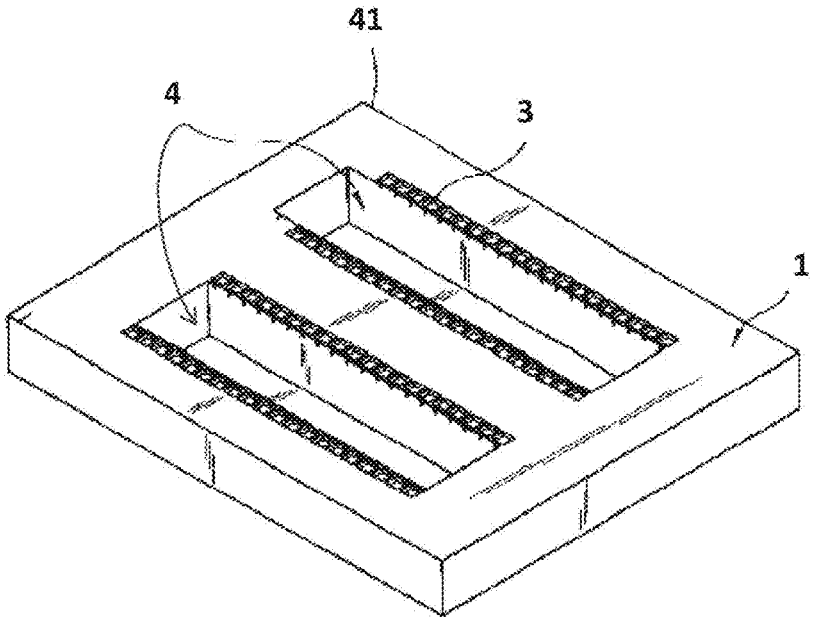
Figure 25:
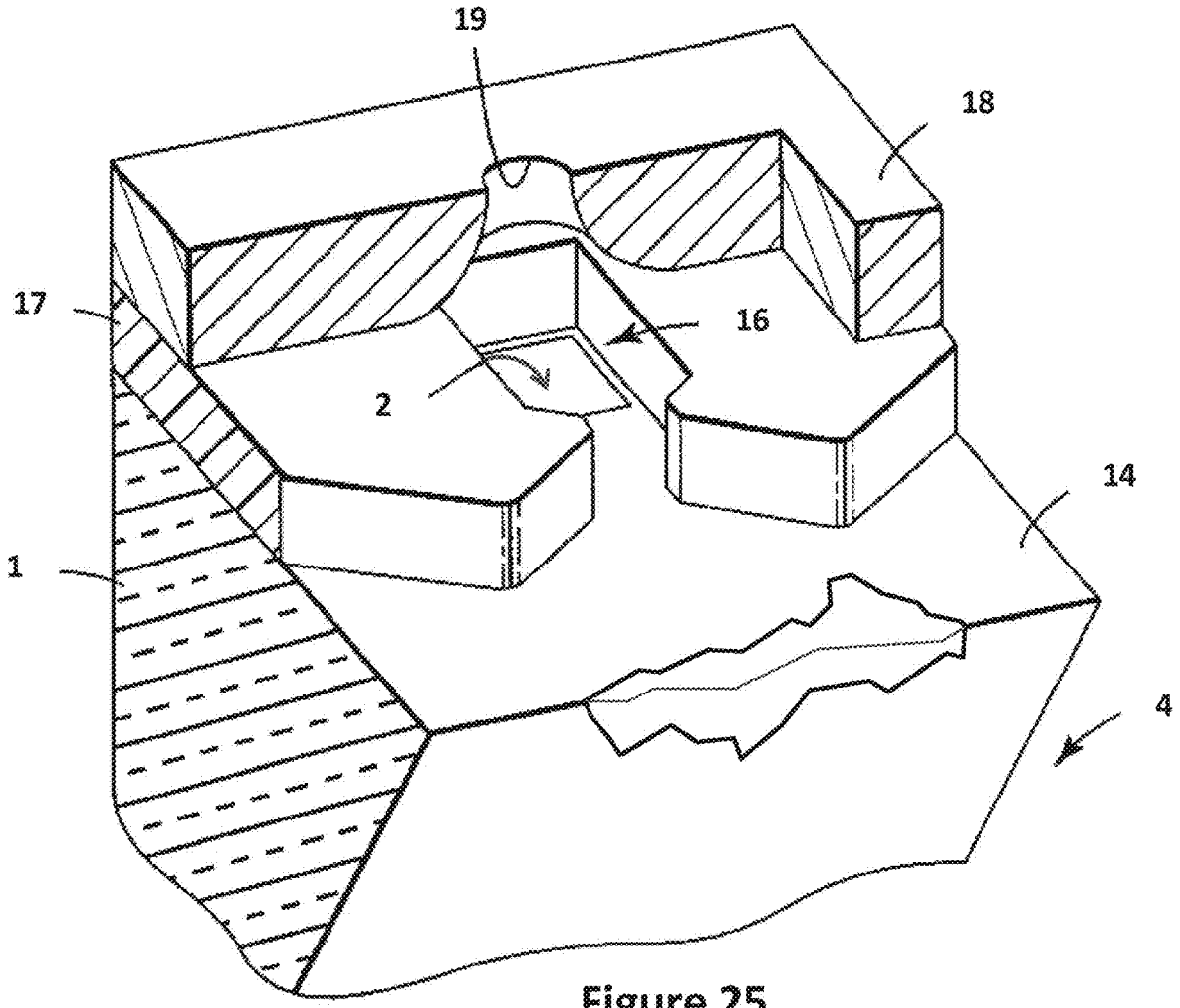
Figure 26:
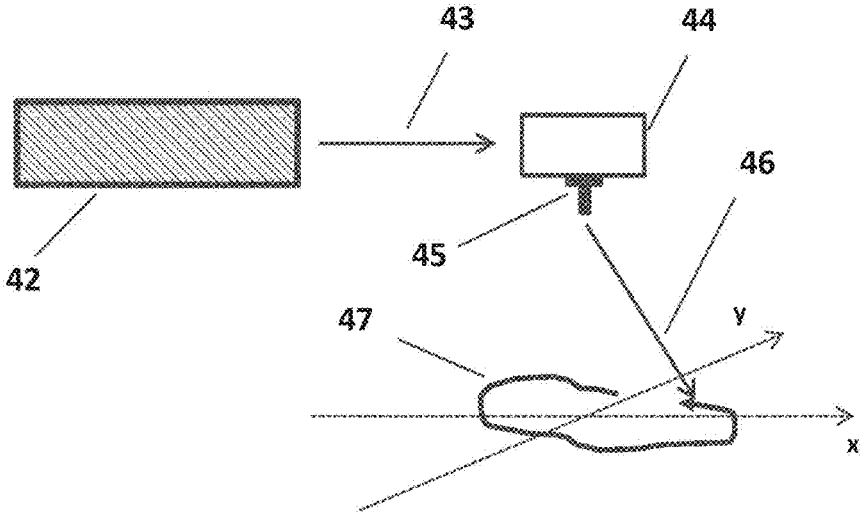
Figure 27:
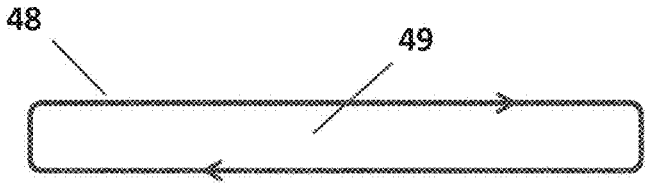
Figure 28:
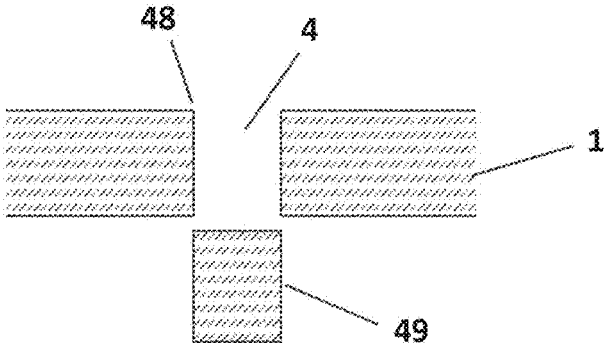
Figure 29:
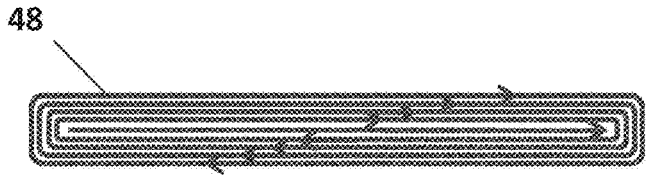
Figure 30:
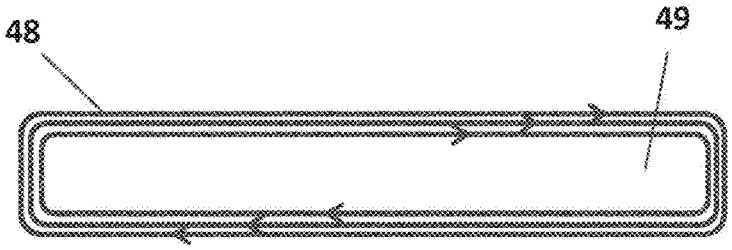
Figure 31:
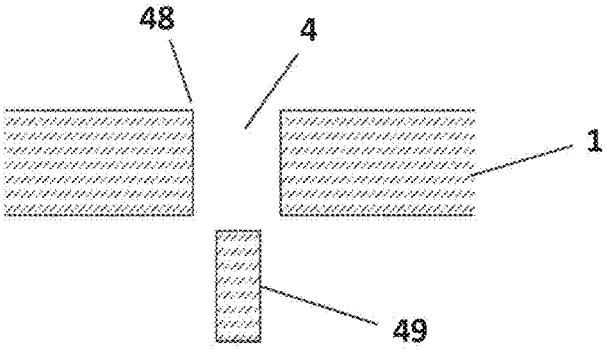
Figure 32:
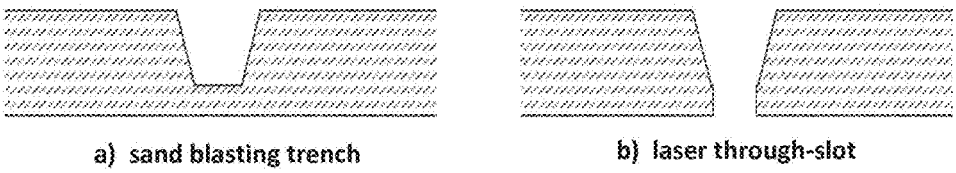
Figure 33:
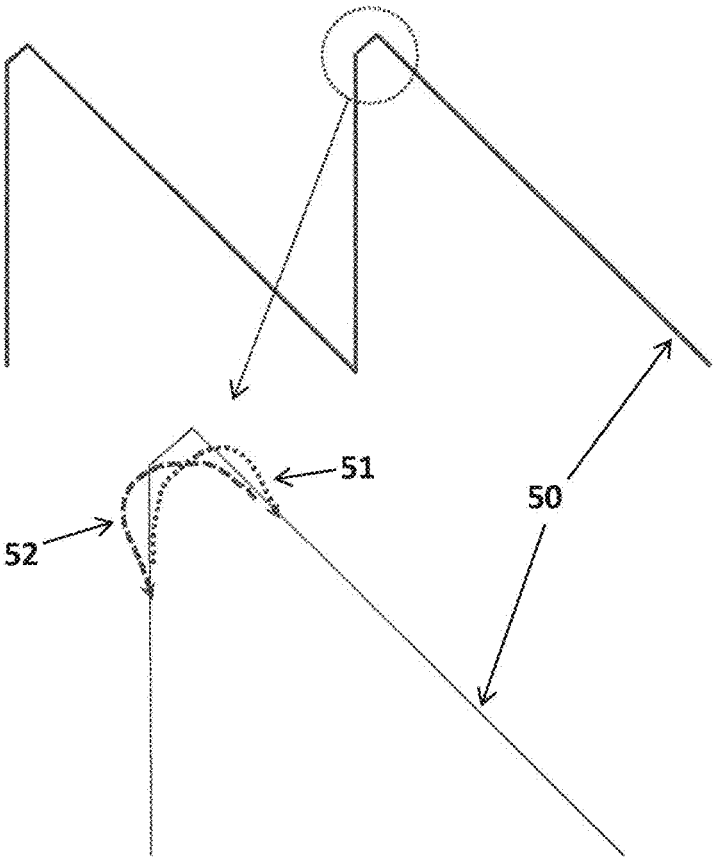

FIG. 8 a step response of an RLC circuit for different values of the damping factor $\zeta$;

FIG. 9 shows a) an equivalent RL circuit and b) a refilled volume vs. time for a cylindrical nozzle;

FIG. 10 shows a nozzle cross sectional view after refilling with ink meniscus overshooting;

FIGS. 11*a*, 11*b* and 11*c* show, FIG. 11*a*, a contact angle $\beta$ between a liquid and a surface—critical value $\beta_{cr}$, FIG. 11*b*, a contact angle $\beta$ between a liquid and a surface—stability with $\beta<\beta_{cr}$ and FIG. 11*c*, a contact angle $\beta$ between a liquid and a surface—instability and spreading with $\beta>\beta_{cr}$;

FIG. 12 shows a nozzle plate surface wetting by effect of an excessive overshooting of the ink meniscus;

FIGS. 13*a* and 13*b* show, FIG. 13 *a*, a nozzle plate surface treatment with a hydrophobic coating and FIG. 13 *b*, a nozzle plate surface treatment by a plasma functionalization with hydrophobic groups;

FIG. 14 shows a logical organization in groups (rows) and blocks (columns) of a plurality of heaters;

FIG. 15 shows a staggered heater layout in a block;

FIG. 16 shows a numerical simulation of the fluidic behavior of nozzles with different channel length;

FIGS. 17*a* and 17*b* show, FIG. 17*a*, a nozzle column without staggering and with a unique block of heaters and FIG. 17*b*, a nozzle column without staggering organized in a plurality of blocks;

FIG. 18 shows a single block of heaters with a progressive staggering;

FIG. 19 shows a series of contiguous blocks in a print head with saw-tooth slot edge;

FIG. 20 shows a single block of heaters with a distributed staggering, divided in sub-blocks;

FIG. 21 shows a series of contiguous blocks divided in sub-blocks in a print head with saw-tooth slot edge;

FIG. 22 shows a sand blasting equipment for silicon wafer micromachining;

FIG. 23 shows a) a material removal through sand blasting process and b) a final through-hole;

FIG. 24 shows machined slots in a print head;

FIG. 25 shows a damaged substrate due to the silicon chipping in the sand blasting process;

FIG. 26 shows a laser workstation for micromachining;

FIG. 27 shows a perimeter cutting process;

FIG. 28 shows a plug dropping in the perimeter cutting process for slot micromachining;

FIG. 29 shows a full internal ablation process;

FIG. 30 shows a boundary stripe ablation process;

FIG. 31 shows a reduced size plug dropping in the boundary stripe ablation process for slot micromachining;

FIG. 32 shows a combined sand blasting+laser slot micromachining process; and FIG. 33 shows a saw-tooth slot edge with compensating clockwise and counterclockwise trajectories.

DESCRIPTION OF PREFERRED EMBODIMENTS

Figure 1:
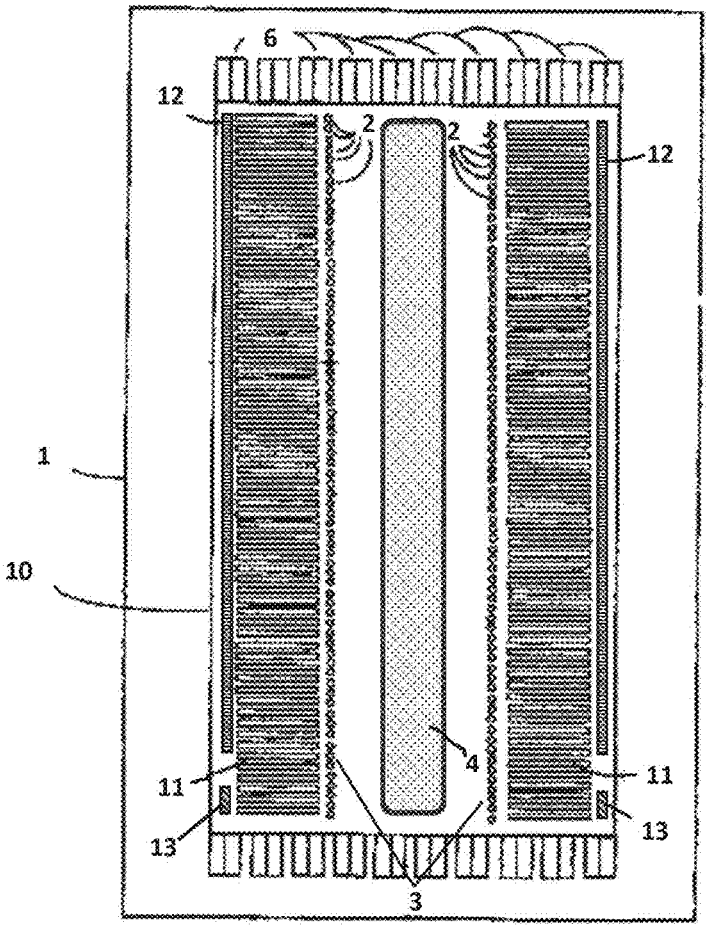
Figure 2:
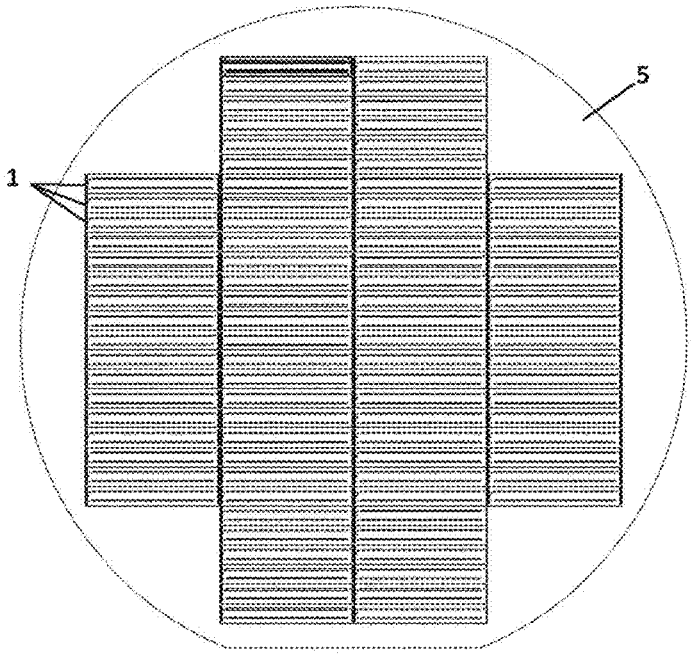
FIG. 2 shows a silicon wafer with print heads.
Figure 3:
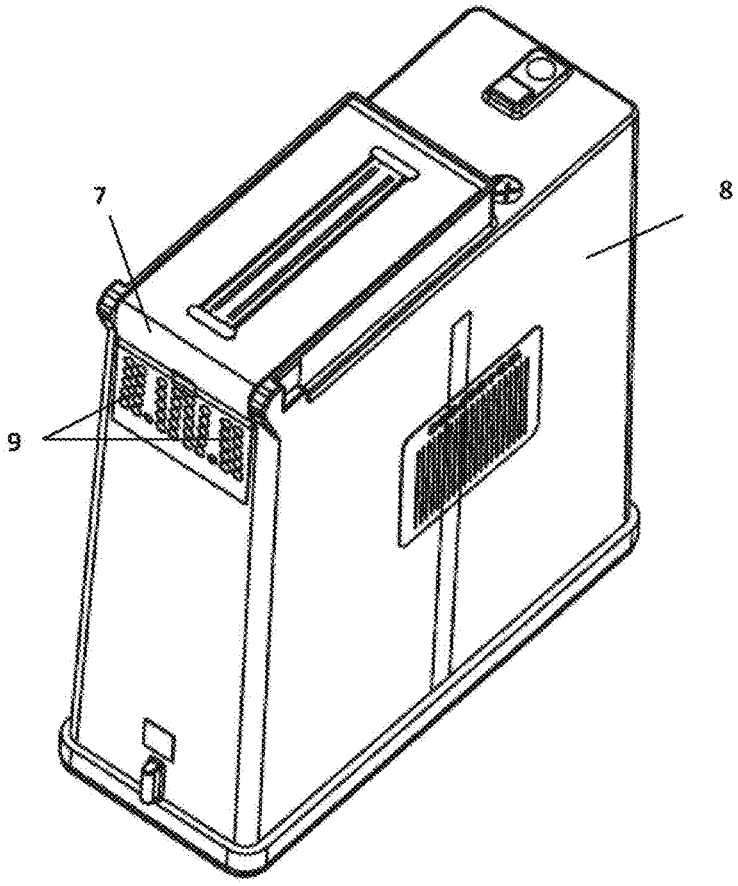
FIG. 3 shows a cartridge with flexible circuit and print head.
Figure 4:
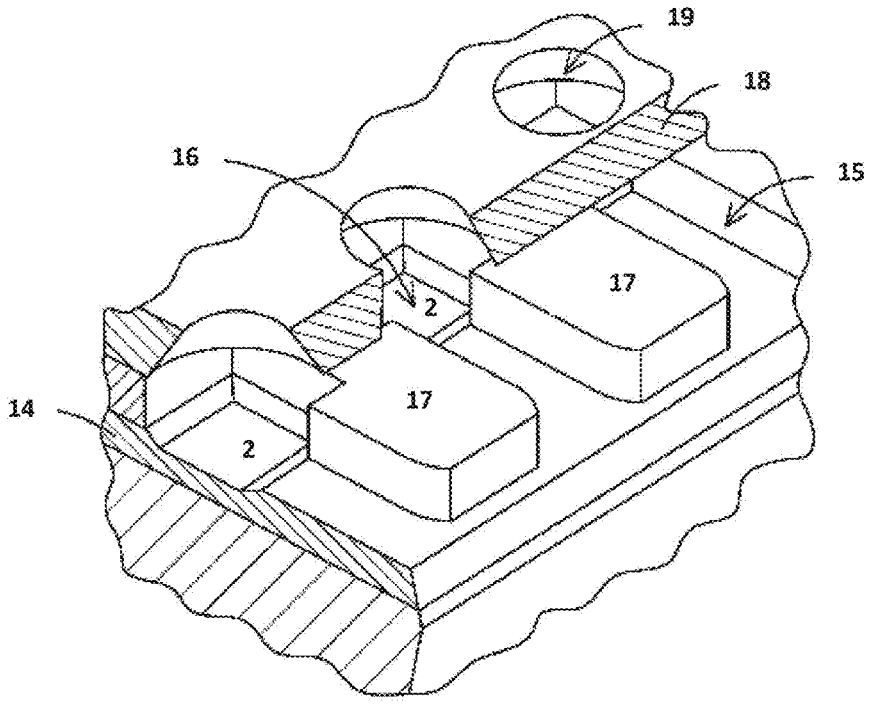
FIG. 4 shows a detail of fluidic circuit and heaters.
Figure 5:
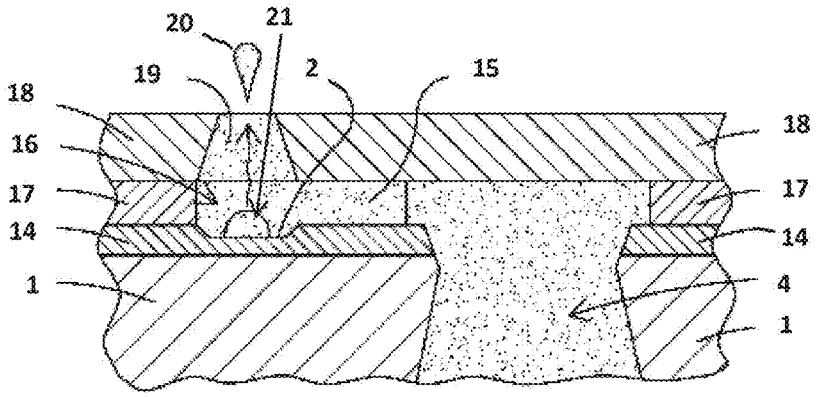
FIG. 5 shows a print head cross sectional view

A thermal ink jet print head (FIG. 1) consists of a substrate 1 which houses on its surface a plurality of heaters 2, arranged in one or more columns 3. Often, the columns are placed in close proximity of a through-slot 4 made in the internal part of the chip to allow the ink refilling. Often, the thermal print heads are manufactured (FIG. 2) in an unique silicon wafer 5, subsequently diced in single chips, using the semiconductor technology, including thin film deposition, photolithography, wet and dry etching techniques, ion implantation, oxidation, etc. The heaters 2 are made of a resistive film, contacted with suitable conducting trails. The peripheral region of the chip comprises a set of contact pads 6 which are bonded to a flexible printed circuit by e.g. a TAB process. With reference to FIG. 3, the flexible circuit 7 is attached to the print head cartridge body 8 and houses larger contact pads 9 to exchange electrical signals with the printer. With an increasing number of heaters, also the complexity of the electronic layout increases. The active part 10 of the substrate 1 includes arrays of transistors 11 for the resistors addressing, logic circuits 12, programmable memories 13 and other devices. As described in FIG. 4 and FIG. 5, onto the chip surface, where resistive, conductive and dielectric films 14 have been previously deposed and patterned, is realized the microfluidic circuit. The ink flows in the microfluidic circuit through suitable channels 15 and arrives into the ejection chamber 16, whose walls surround the heating resistor 2. The microfluidic circuit is patterned in a suitable polymeric layer 17 called barrier layer. A nozzle plate 18 is assembled above the barrier layer and houses a plurality of nozzles 19, aligned with the underlying heating resistors, from which the ink droplets 20 are ejected. In fact, a short current pulse heats the resistor 2, which in turn causes the vaporization of a thin layer of ink just above it and the forming of a vapor bubble 21. The pressure in the vaporized layer increases suddenly, causing the ejection of part of the overlying liquid from the nozzle. The ink drop travel toward the medium, producing an ink dot on its surface. After that, new ink is recalled into the chamber, to replace the ejected drop, until a steady state is reached: the ink flow is ruled by the fluid dynamics, which implies driving forces, inertia and resistance to the flow. The fluid parameters (density, viscosity surface tension, etc.) play a role as well as the geometrical shape of the circuit, where the long and narrow paths produce a higher flow resistance compared with the short and wide ones. The flow resistance is one of the parameters which influence the chamber refilling time and, therefore, also the maximum operating frequency of the print head.

Figure 6:
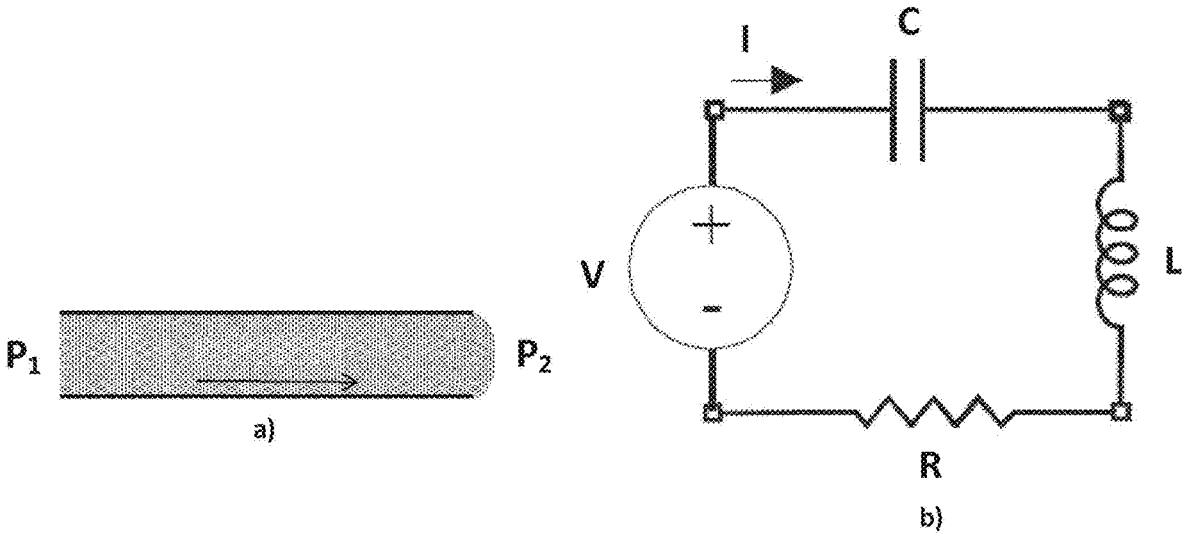
FIG. 6 shows a) an example for a fluidic circuit and b) an electrical RLC equivalent lumped parameter model.

To have a better understanding, it is convenient to adopt a model of the fluidic behavior of the system, as depicted in FIG. 6. A "lumped parameter model" is adequate to describe the characteristics of the hydraulic circuit. It is schematized as an RLC electric circuit, where L represents the inertial aspect of the fluid, R depends on the viscous resistance of the liquid flowing in the circuit and C is related to the pliability of the circuit boundary, including the ink meniscus oscillation at the air interface. An additional pressure differential established between the inner part of the fluidic circuit and the external atmospheric pressure can be introduced like a voltage source in an electric circuit. In the equivalent model, the flow rate plays the role of the electrical current.

Figure 7:
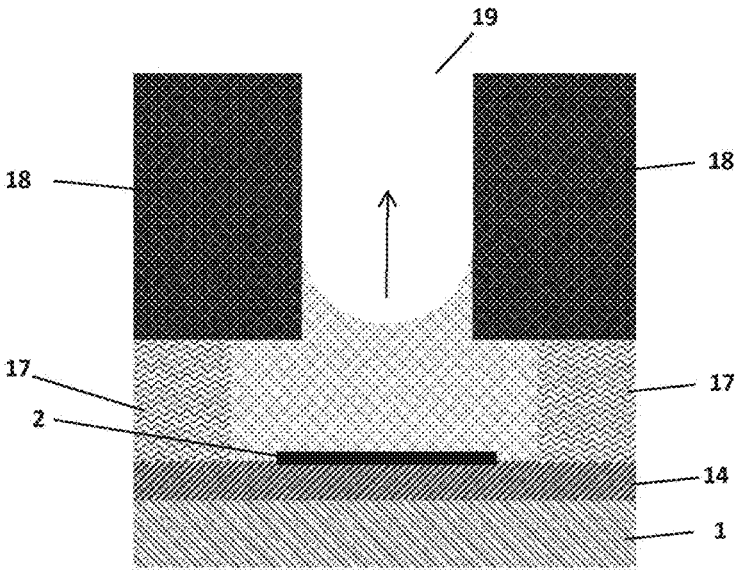
FIG. 7 shows a cross sectional view of an ejection chamber during the nozzle refilling phase.

After the droplet emission, the gas bubble collapses into the ejection chamber, drawing back both the residual liquid left in the nozzle and other liquid from the reservoir, through the fluidic channel. Then the refilling phase of the nozzle takes place. The driving force of the refilling action (see FIG. 7) is due to the inward meniscus curvature of the liquid ink with respect to the nozzle wall. The capillary pressure draws the liquid until it reaches the nozzle edge and then the meniscus undergoes a damped oscillation. The dissipation is due to the viscous resistance of the liquid through the whole circuit and it is obviously related to the geometrical parameters of the latter, like length, cross section, aspect ratio.

In the lumped element model, the relationship between the physical and the geometrical parameters have been widely treated, (H. Schaedel, "A Theoretical Investigation of Fluidic Transmission with Rectangular Cross Section", Third Cranfield Fluidics Conference, May 1968 Turin); the values of R and L for a linear circuit segment Δx with uniform cross section are as follows:

$$L=1.15*\mu*\Delta x/S$$

where μ is the ink density and S in the cross section area;

$$R=8*\pi*\mu*\Delta x/(r\hat{}4) \text{ circular section with radius } r$$

$$R=8*\pi*\mu*\Delta x*K/(a\hat{}2*b\hat{}2) \text{ rectangular section with sides } a,b$$

where μ is the ink viscosity and K is a coefficient which depends on the aspect ratio b/a of the rectangle; for a nearly square cross section (a=b) R turns out to be proportional to 1/(a^2*b^2), whilst when b/a>>1 R tends to become proportional to 1/(a^3*b). If the cross section of the circuit portion is not uniform, an integration should be performed to obtain the parameter values.

If the boundary walls of the circuit are rigid and the only pliability of the system is due to the meniscus oscillation at the nozzle edge, a mean value for the "capacitance" C turns out to be:

$$C=(\pi*d\hat{}4)/(64*\sigma)$$

where d is the nozzle diameter and σ is the surface tension of the ink.

A suitable damping factor ζ can be defined:

$$\zeta=R/2*\text{sqrt}(C/L)$$

which characterizes the damped oscillating system. If ζ>1 the oscillation is overdamped: in fact no oscillations take place in the system. If ζ<1 the system is underdamped and actually undergoes a damped oscillation; the timescale of the exponential amplitude decay of the oscillation is characterized by the attenuation □, which turns out to be:

$$\alpha=R/2L$$

If ζ=1 (critical value), the critical damping of the system reached, i.e. the critically damped response represents the fluidic circuit response that decays in the fastest possible time without going into oscillation. This behavior is desirable when it is required to reach the steady state as quickly as possible; the overdamping eliminates even more the oscillations, but it requires a longer time to stabilize. In fact, a controlled underdamping situation is pursued in the fluidic circuit design as otherwise, the timing of the fluidic dynamics would be too long and unfit for the high speed printing. The step response of a RCL circuit for different values of the damping factor is illustrated in FIG. 8.

The exact determination in a time interval of the dynamical liquid behavior requires a mathematical simulation made with sophisticated algorithms, but an insight in the properties of the fluidic circuit can be obtained using an analytical approach with a simplified model.

As mentioned above, after the collapse of the vaporized gas bubble and the withdrawal of the residual ink, the nozzle refilling is due to the capillary pressure that acts as a driving force for the liquid that flows through an impedance defined by the $R_{total}$ and the $L_{total}$ of the fluidic circuit, which includes the feeding channel between the ink reservoir and the chamber.

Considering, just for simplicity, a cylindrical nozzle of diameter d, partially filled with ink and assuming the perfect wettability of the internal nozzle wall (ideal situation), the capillary pressure p exerted by the meniscus on the liquid can be defined as:

$$p=4*\sigma/d$$

If the nozzle impedance is less than the impedance of the rear circuit part, which includes both the chamber and the feeding channel, the R and L values do depend substantially on the latter items. Since there isn't any meniscus oscillation before reaching the nozzle edge, the capacity parameter C doesn't play a role during the whole nozzle refilling phase (it could be assumed C=infinity), the equivalent circuit comes down to be a simple RL circuit, where the capillary pressure acts like a DC voltage source.

The refill time T is depending on the empty volume of the nozzle, which depends on the ejected drop volume (it turns out to be slightly larger, because of the dynamic liquid recoil). For the simple RL equivalent system (FIG. 9*a*), the exponential part of the flow rate trend is characterized by the time constant $\tau$;

$$\tau=L/R;$$

the flow rate q turns out to be:

$$q=p/R*(1-e^{\wedge}(-t/\tau)$$

By integration, the expression for the displaced volume of liquid can be obtained:

$$V=(p/R)*t-(p/R)*\tau*(1-^{\wedge}(-t/\tau))$$

Typically, when the liquid gets the nozzle edge, the contribution of the exponential part is nearly zero: the presence of the inertial parameter L causes a delay $\tau$ in the refilling time, compared with the case of pure dissipative circuit. In FIG. 9*b*, the trend of the refilled volume vs. time is represented; the dashed straight curve represents the pure dissipative circuit (i.e. zero inertia). Asymptotically, the two lines have a horizontal displacement equal to $\tau$, the time constant of the RL equivalent circuit. Therefore, we get for the refilled nozzle volume $V_{nozzle}$ the simplified formula:

$$V_{nozzle}=(p/R)*(T-\tau)$$

which, in turn, gives the value for the refilling time T:

$$T=V_{nozzle}*(R/p)+\tau$$

In principle, a large drop volume requires a large diameter nozzle, which generates a low capillary pressure: the formula above indicates that a large drop volume involves a high refilling time. Scaling down the nozzle diameter to reduce the drop volume allows achieving a shorter T.

Once the liquid approaches the nozzle edge, the damped oscillations of the meniscus takes place. This phase requires the use of the complete RLC model, to take in account for the meniscus swinging around the steady state point. The oscillation damping factor $\zeta$ can also be expressed in term of time constant $\tau$:

$$\zeta=R/2*\mathrm{sqrt}(C/L)=(½)*\mathrm{sqrt}(R*C/\tau)$$

If $\zeta>1$ the oscillation is overdamped: in fact no oscillations take place in the system; if the system is underdamped ($\zeta<1$), it oscillates with the attenuation $\alpha$ previously defined; for the underdamped oscillator $\alpha$ is related to the time constant $\tau$ by the formula $\alpha=1/(2*\tau)$. As mentioned above, a critically damped circuit where $\zeta=1$ would be generally considered as the best one but, practically, the constraints from the circuit parameters due to the expected drop volume and operating frequency force to accept a lower $\zeta$ value in the design of the microfluidic pattern, looking for a controlled underdamping situation.

To guarantee a perfectly stable and repeatable drop ejection, a new ejection pulse could be applied to a heater only when the liquid in the corresponding chamber has reached its steady state, but this approach would require a time between consecutive pulses which is too long to be compatible with the high speed printing. In fact, ejection pulses applied when the meniscus hasn't yet reached its steady state can cause a certain scattering in the drop volume and speed, but that turns out to be acceptable for the most part of the applications; therefore, it is not necessary to wait for the complete oscillation damping before ejecting the next drop. The only mandatory requirement is the complete nozzle refilling. To have a uniform and predictable ejection of the ink droplet it is necessary that the thermal activation of the heater in a chamber takes place only when the refilling of the nozzle is complete. Otherwise, a sudden reduction of the drop volume followed by the nebulization of the liquid would happen, with detrimental effects in the printing quality. On the contrary, applying the ejection pulse just after the nozzle refilling allows the correct droplet emission without penalizing the maximum operating frequency and so enabling the high speed printing.

However, a possible drawback can originate during the oscillation phase from the wetting effect of the overshooting meniscus with respect to the outer surface of the nozzle plate (FIG. 10). The outward protruding of the ink meniscus 22 (schematized as a sphere segment) from the nozzle edge, determines an angle $\beta$ with the nozzle plate surface 23. The more the meniscus is overshooting, the higher is the contact angle with the surface. If this angle reaches the critical wettability angle between the liquid and the surface (i.e. the largest contact angle at which the liquid drop can maintain its shape on the surface, without spreading out), the liquid ink could spread throughout the nozzle plate surface, instead of remaining confined within the nozzle boundary. In FIGS. 11*a*, 11*b* and 11*c* it is illustrated the liquid behavior when the contact angle is either below or above the critical wettability angle $\beta_{cr}$. The wetting of the nozzle plate surface from the ink (FIG. 12) causes severe effects in the printing quality and must be absolutely avoided, controlling the maximum meniscus overshooting through a suitable choice of the fluidic circuit. Often the nozzle plate surface is treated to increase the critical wettability angle (FIGS. 13*a* and 13*b*). Thin film deposition of hydrophobic materials 24 and plasma surface modification with hydrophobic functional groups 25 are widely used for this purpose. On the other hand, it is important to maintain the high wettability of the internal nozzle walls, which contributes to speed up the nozzle refilling phase.

To sum up, the optimization of the ejector performance is based on two main parameters. The refilling time T as short as possible to have a high working frequency and a suitable damping factor $\zeta$ which maintains the meniscus oscillation below the critical wettability angle. In fact, the damping factor influences the overshooting of the meniscus and the contact angle, since a strong damping tends to produce a restrained liquid protrusion. For this purpose, the largest possible damping factor would be desirable but, unfortunately, it cannot be adjusted independently, without affecting other fluidic quantities: in fact, the parameter choice which makes $\zeta$ very large influence the T value as well. As mentioned above, a controlled underdamping is pursued to reach a trade-off between high frequency and printing quality. To go in more detail, a predetermined value $\beta_{ref}$ is assumed as a reference angle in the fluidic circuit design and the parameters are optimized so that meniscus angle gets this limit value without going over. $\beta_{ref.}$ is set just below the critical wetting angle, to leave a safety margin to the meniscus oscillation; definitely, $\beta_{ref.}$ is the dominating parameter in the optimization of the fluidic circuit, in order to prevent the surface wetting from the ink.

The refilling time $T=V_{nozzle}*(R/p)+\tau=V_{nozzle}*(R/p)+(L/R)$ is penalized by a high value of the time constant $\tau$, therefore a low $\tau$ value decreases the refilling time and, in turn, increases the damping factor $\zeta$, tends to reduce the risk of surface wetting. The rear circuit part, constituted by the feeding channel, largely determines the value of the parameters L and R. Assuming for simplicity a square cross section of the channel, it turns out that the ratio L/R is proportional to the cross section S. Reducing the size of the channel cross section would give a lower value of $\tau$. On the other side, the resulting higher value of R would however increase the (R/p) term, raising the total refilling time T. Therefore, to limit the value of R, it is also necessary to shorten the channel length. An iterative optimization procedure maintains the damping factor at the reference value, minimizing as much as possible the refilling time.

As previously mentioned, in a print head, the silicon chip is assembled to a cartridge, where is the ink reservoir. In many cases, the ink flows toward the microfluidic circuit through one or more slots cut in the internal region of the substrate: the slots put in fluidic communication the opposite substrate surfaces and the ink can arrive through the slots to the ejection chambers. Different approaches can be followed in the slot design and manufacturing; commonly, one or more slots extend longitudinally throughout the substrate and one or two nozzle columns are flanking the slot edges, which are substantially linear. The extension of the nozzle columns along the longitudinal chip axis is called "swat". Moving the print head with respect to the medium in a direction which is normal to the longitudinal chip axis, a printed region of the medium with the swath height can be obtained.

Since a heater in the array is energized by a current pulse, a large current flows through the electronic circuitry on the substrate when many heaters are energized simultaneously. To minimize the current peaks during the printing, the print head is designed in such a way that the heaters in a column are organized in a matrix arrangement. On the one hand, the heaters of the array are divided in "groups", where only the heaters belonging to the same group can be energized at the same time; on the other hand, the nozzle column is composed by "blocks", sometime called "primitives", were heaters belonging to different groups are present: only one resistor at a time can be energized within a block, whilst corresponding resistors (i.e. resistors belonging to the same group) in the various blocks can eject a drop in the same moment. The logical organization of a plurality of heating resistors in a matrix with m rows (corresponding to the groups) and n columns (corresponding to the blocks) is sketched in FIG. 14. The different groups are driven in succession (t 1<t2 . . . <tm), with a certain delay, to distribute the current pulses in a larger time interval, reducing the possible issues due to an excessive level of current flowing in the circuitry; when a group is activated, the group heaters distributed throughout the various blocks can be energized all together: therefore, the maximum current peak is equal to the single heater peak multiplied by the total number of blocks.

To compensate for the difference in the ejection timing of the various groups, the nozzles and the corresponding underlying resistors are staggered along the direction of the relative movement between medium and print head, according to their own time delay. All the resistors belonging to the same group distributed in the various blocks have the same staggering value. Therefore, each heater columnar array shows a kind of "waviness", rather than being strictly linear. In FIG. 15 the waviness of the heaters 2 is shown. The closer the heater to the direction of the print head relative movement, the sooner the activation takes place. On the contrary, the outer profile of the slot 4 is substantially linear in the prior art, due to technological reasons; therefore, the actual distance between a resistor and the slot edge is different, depending on the group, the heater belongs to. This fact causes a spread in the fluidic resistance of the various ejection sites in the array, affecting in turn the stability and the operating frequency of the print head.

As more the heater is distant from the slot edge, as longer is the rear feeding channel through which the ink flows to the ejection chamber. The channel extension moves the system far from the optimized situation, increasing both the refilling time T and reducing the contact angle β. The latter parameter turns out to be even less critical with respect to the reference value $\beta_{ref}$, but T should be adjusted, to prevent a strong reduction of the print head operating frequency. To adjust the augmented refilling time due to the longer channel, it is necessary to act on the channel cross section, enlarging its size. In fact, in the prior art individual adjustments of the microfluidic circuit layout were made using this method, to compensate the issue arising from the augmented T (see for example U.S. Pat. Nos. 6,042,222 and 6,565,195). The widening of the channel cross section induces also a reduction in the damping factor; since the longer channel caused an extra-damping, there is some margin in widening the cross section, until β returns to the reference value $\beta_{ref}$.

This method can help in relieving the issues due to the different path length, but it causes a higher complexity in the design of the fluidic circuit and the visual process control after the patterning of the barrier layer turns out to be cumbersome, because different channel shapes must be checked. However, the fluidic circuit adjustment produced by the above mentioned method is only partial. Since the various fluidic quantities depend on the geometrical circuit parameters with different functional relationships, it is not possible to recover completely the refilling time, getting a perfect compensation of the different channel length due to the staggered nozzle array, unless going below the critical damping value. Therefore, in the prior art a situation which is not perfectly optimized must be accepted, with a certain penalization of the operating frequency. This aspect is illustrated in FIG. 16, through the simulation of a real (not idealized) fluidic circuit, where both the refilling volume as well as the contact angle vs. time are sketched in the diagram. The nozzle which is the closest to the slot edge has the shortest channel and the minimum refilling time and, therefore, it has the maximum operating frequency: it is assumed as a reference in the fluidic circuit design and the parameters are optimized so that meniscus angle gets the limit value, just below the critical wetting angle; on the contrary, the most distant nozzle has a higher refilling time and a lower contact angle. We can try to correct the drawback due to the reduced operating frequency acting on the geometrical parameters of the channel, until we reach the limit contact angle of the fastest nozzle. It turns out that the refilling delay can be recovered only partially and the overall operating frequency of the print head must be scaled down to the slowest nozzle.

From this consideration and from the mathematical analysis carried out above, it turns out that the best solution is to have short channels with the same length for all the nozzles. This would allow a real equalization of the fluidic dynamics of the nozzles, enabling to achieve the highest operating frequency. A new approach to equalize the fluidic behavior of the different ejection sites is eliminating the spread of the distances between the heater and the slot edge.

A trivial solution would be designing a layout where all the heaters in a column stay on a straight line which is parallel to the slot edge. Since all the resistors would be placed on the same line, the print head should be rotated by a certain angle with respect to a line perpendicular to the relative movement direction, to avoid the excessive current peak generated in the simultaneous activation of the resistors. On the contrary, the rotation would allow a delayed activation of each resistor with respect to the previous one.

To match the nozzle position with the expected horizontal printing resolution, which corresponds to the reciprocal of the gap G between two consecutive vertical printing lines, there are two possible choices in the rotation angle, fulfilling alternatively the following conditions: 1) making the distance between the orthographic projection with respect to the relative movement axis of the first and the last nozzle in a column to be equal to the gap G; 2) making the distance between the orthographic projection with respect to the relative movement axis of the corresponding nozzles (i.e. belonging to the same group) of two adjacent blocks in a column to be equal to the gap G. In the first case (FIG. 17*a*), the column would be organized in a unique block, the inclination would be very small and the delay between consecutive activation pulses would result too short with respect to the pulse duration, causing in fact the overlap of many current pulses. The current peak would be anyhow excessive and the adopted solution wouldn't really fix the problem. In the second case (FIG. 17*b*), it could be possible maintaining the nozzle organization in a plurality of blocks, where only one nozzle is energized at a time and, therefore, the maximum current peak is related to the number of blocks in the array. In this case, the rotation angle would be very large, and the resulting actual swat would be strongly reduced. It would be necessary to increase the chip length to keep the same vertical resolution as well as the same swath height of a not-rotated print head. Thus, the actual chip area would result too large and this solution wouldn't be compatible with a high yield manufacturing process.

According to the invention the staggered arrangement of the heaters with respect to the longitudinal axis and the matrix organization in "staggering groups" and "primitive blocks" are maintained, but the equalization of the flow path lengths is achieved giving the slot a suitable shape in such a way that its edge follows the position of the staggered resistors. In one embodiment, illustrated in FIG. 18, the staggered position with respect to the longitudinal print head axis of the heaters belonging to a single block 26 can be implemented with a progressive displacement of the heaters belonging to the different staggering groups. In such an arrangement all the nozzles of the block stay along an inclined segment and so the firing order takes place subsequently from one heater to the next one, according to the staggering position SP1, SP2 . . . etc. which are progressively more distant from the direction of the relative movement and, therefore, arrive one after the other at the same vertical printing line. A saw-tooth shape of the slot edge profile 27 would fit well to this situation: the length of each "tooth" would correspond substantially to the length of one block along the column and the heaters would maintain a substantially uniform distance with respect to the slot edge, resulting in a uniformity of the fluidic behavior.

This nozzle arrangement suffers of a potential drawback, due to the close proximity of the heaters which are activated one after the other. In fact, when a current pulse goes through a resistor, a thin ink layer just above is vaporized; suddenly, the vapor layer undergoes a strong pressure raise, which is transmitted to the overlying liquid, causing a rapid liquid movement and the ejection of an ink droplet from the nozzles; after the ejection, new ink is drawn into the nozzle and, once the refilling has been completed, the system is ready to receive another current pulse. During the time interval after the resistor excitation, which includes bubble expansion, drop ejection and nozzle refilling, some physical effect (pressure peak, liquid flow, turbulence, etc.) can take place in the surrounding environment, perturbing the neighboring ejection chambers.

Therefore, a different nozzle arrangement is preferred: in the ejection timing sequence, contiguous pulses don't take place in adjacent nozzles, so that the possible perturbations due to a remote heater turn out to be very weak. In such an arrangement (FIG. 20), each block 26 could be divided in several sub-blocks 28 of nearly aligned, adjacent heaters; consecutive pulses are sent to resistors belonging to different sub-blocks, to avoid interferences. In this case, a possible edge profile able to equalize the flow path lengths would still have a saw-tooth shape, with a higher number of "teeth" FIG. 21) having a shorter length.

Usually, a common method to realize a through slot is to use the sand blasting process (FIG. 22). In the sand blasting equipment 40 a thin jet 29 of alumina particles is shot at high speed against the substrate to machine. A sand blasting unit 30 draws the alumina 31 from a reservoir 32, driving the particles into a nozzle 33 by means of a high pressure air flow coming in from the inlet 34. The alumina grains shot out from the nozzle hit the surface 35 of a silicon wafer 36, removing (FIG. 23*a*) small fragments 37 of the substrate. In this way a hole or a trench 38 can be dug, by means of the material blasting; if the process is prolonged, it can get the opposite surface, producing a through-hole 39 (FIG. 23*b*), or a through slot, as illustrated in FIG. 24, where a single silicon chip with two parallel slots 4 is shown. The dicing process is among the phases which take place after the slot machining. By a sawing equipment, the single chip 1 limited by its perimetral edge 41 is obtained from the wafer. The sand blasting equipment can be completed with optical instruments like microscope, camera, frame grabber etc. for alignment and inspection as well as with motorized slides for the machining of large workpieces (not shown in the drawing). The sand blasting process turns out to be very cheap and fast. It is widely used by many manufacturers to produce the ink feeding slots in the print heads. Nevertheless, it has several issues: in a through-slot process for a print head, the fragment produced during the machining (either due to the alumina or to the blasted silicon) can damage the microfluidic circuit, which is made in a polymeric layer; moreover, the exit slot edge is often very irregular, because it is difficult to control accurately the geometrical resolution of the machined pattern. As depicted in FIG. 25, sometime chipping or silicon cleavage 42 can arise during the sand blasting, resulting in an increased defectiveness induced in the devices. If the former issue can be controlled using a suitable coating material (e.g. EMULSITONE 1146 by Emulsitone Company, which is water soluble), the latter turns out to be much more dangerous and it limits the possibility to scale-down the device, using the sand blasting process to machine a through-slot with smaller features.

Alternative processes can involve wet as well dry etching: they can be really effective to produce vias, trenches and also through-holes in a silicon wafer with a good resolution; however, the mask requirements for these processes bring in severe constraints and the compatibility with the microfluidic barrier present onto the substrate is a rather intricate matter to deal with; moreover, it would be difficult to apply the microfluidic barrier layer on a substrate where a through-slot has been already machined. Yet, the mentioned solutions could be carried out with sophisticated techniques, providing a saw-tooth profile as specified in the invention. Nevertheless, in a preferred embodiment a method able to provide a good quality saw-tooth edge for the feeding slots without the afore cited complications is desirable.

Laser ablation is an effective method to realize pattern in many kinds of different materials. Usually it is used to cut metals, ceramics, glass, semiconductors, plastic. The characteristics of the laser (mainly: emission mode, wavelength, pulse duration) and the properties of the material determine the effects of the interaction. Generally, when the absorption coefficient of the radiation is high, the interaction is very strong and the laser beam energy can be efficiently transferred to a small volume of the material, causing the disruption of the chemical bonds and the fragment ejection. This effect is much stronger when pulsed lasers are used. Moreover, when the laser pulse is very short, the extension of the HAZ (heat affected zone) inside the substrate is reduced, increasing the ablation efficiency and attenuating the thermal side-effects, with a resolution improvement of the machined pattern. Solid state lasers are very effective to perform micromachining processes. They can deliver high energy radiation pulses at high repetition rates. The emitted wavelength can be adequately absorbed by a silicon substrate, especially when higher harmonics generation is exploited. Industrial solid state lasers are currently available. They turn out to be very reliable, with stable performances, low running costs and high MTBFs (Mean Time Between Failures). Therefore they are fully adequate for the manufacturing of thermal print heads.

The radiation emitted by a solid state laser can be focused onto the workpiece in a spot having the diameter of few microns, increasing the surface energy density and allowing the machining of features with high resolution. To perform the ablation pattern the workpiece can be moved under the laser beam using motorized slides, but often scanning the beam across the substrate using piezo-driven mirrors turns out to be more convenient, because in this way high acceleration peaks of the substrate are avoided. Sometimes a combined process, where both methods are applied, is used, mainly when large substrates have to be worked. In FIG. 26 a laser working station is described. A laser source 42 emits a beam of electromagnetic radiation 43, which goes into a scan head 44: through a suitable deflection, the scan head provided with the focusing lens 45 is able to steer the exit beam 46 according to a predetermined trajectory producing a focused spot on the xy workpiece surface, determining the ablation pattern 47.

A possible way to drill a through slot in a silicon substrate is cutting the slot perimeter (FIG. 27). The laser can be cyclically moved along the outer profile 48 of the slot: each cycle causes an increasing of the depth in the narrow kerf produced at the perimeter, until the internal plug 49 drops down, leaving the slot area fully opened as shown in then cross section illustrated in FIG. 28. In spite of the apparent quickness and simplicity, this method isn't very effective. It can be advantageous to machine very thin substrates (e.g. silicon wafer with a thickness below 200 microns), where few laser shots can reach the opposite surface, but it turns out to be too lengthy when thicker substrate are worked. In fact the total processing time results not proportional to the wafer thickness. On the contrary, the process of a thick substrate is penalized by the partial re-deposition of the ablation debris into the kerf. Exhaust extraction can somewhat alleviate this effect, but a substantial part of the previously removed material must be ablated again, lengthening the processing time needed to cut off completely the internal silicon plug 49.

To prevent the obstruction of the narrow kerf from the debris, an alternative method is to spread the laser ablation throughout the whole surface inside the slot perimeter (FIG. 29). Obviously, the total path length covered by the laser spot in a single surface sweep is much larger than the length of the slot perimeter. Nevertheless, the debris obstruction of the ablated region is dramatically reduced when the whole internal area is machined, layer after layer, until the complete breakthrough of the slot. Definitely, the full ablation of the internal area turns out to be faster than the cyclic contouring of the perimeter.

If the internal area of the slot is large, even the full ablation process is too long for the manufacturing requirements. In this case, another approach may be used, which can be defined as an enlarged perimeter contouring. Instead of insisting on a single perimeter line, the ablation is carried out over a larger stripe, which has the perimeter as outer boundary. The stripe width should be large enough to allow an effective removal of the ablation debris: three times the spot diameter or more are necessary (FIG. 30) to get a good ablation rate. The stripe surface is machined, layer by layer, until the remaining internal smaller plug has been cut off (FIG. 31). Using this method, it is not necessary to ablate the total internal area of the slot, but just a smaller boundary stripe. On the other side, the material removal is more efficient, because the ablation is not limited to a narrow kerf and the possibly re-deposed debris cannot cover the whole stripe area.

Attention needs to be paid to the overlap between subsequent spots in the machining process. In fact, a correct relationship between the spot diameter, the laser repetition rate, the linear scan speed and the ablation strategy must be found to optimize the spot overlap with respect to the process quickness as well as the quality of the machined pattern.

To speed up even more the ablation process in the case of a thick substrate, the laser ablation can be combined with other techniques, like sand blasting or wet and dry etch processes. These ancillary techniques can be used for removing part of the material, leaving a thinner silicon thickness, which finally is in turn ablated with the laser. For example, initially the sand blasting can excavate a large trench, without reaching the opposite surface (FIG. 32*a*). Subsequently, the laser beam can be scanned in a suitable region inside the trench, to complete the ablation with a better resolution (FIG. 32*b*). In an embodiment, both the processes are carried out from the rear part of the wafer, so that the device surface is affected from the ablation debris only in the final part of the process.

In the preferred embodiment, the microfluidic circuit has been designed in order to have a fixed distance D between each heating resistor and the neighboring slot edge, so that the fluidic parameters are equalized throughout the whole plurality of nozzles. Different patterned layers constitute the print head chip, realizing the electronic as well as the fluidic circuit. Dielectric, resistive, conductive, protective layers are arranged on the substrate to produce all the necessary modules. Multiple layers may be formed above one another to form the print head chip as follows. Generally, conductive layers are insulated from the substrate and from each other by suitable dielectric layers, except at the contact vias, where holes are made in the dielectric layer to intentionally allow the electrical contact between the different levels of the circuit. The dielectric layers can also play the role of "thermal-transfer layers" in the region above the resistors: in fact, the heat produced by the current pulse through a resistor flows across one or more dielectric layers above the resistor itself, up to the ink. Such dielectric layers can comprise silicon nitride, silicon carbide or other kind of films (layers). An additional layer is often adopted as a protection against the mechanical shock produced by the collapsing bubble; a refractive metal is frequently used for that purpose, for example tantalum. Since the machining of an ink feeding slot can cause, in principle, some mechanical crack in the device films (layers), it is convenient to remove the layers inside and near the slot region, to avoid any film or layer damage during the slot machining, through a suitable patterning shapes. Particularly, the refractive metal layer and the dielectric above the resistors should be removed, so that the slot area is free of these layers. Alternatively the slot area may be left free during the manufacturing of the different layers. This way it is not necessary to remove layers which have been previously applied on the substrate. In the prior art, where the slot edge is substantially a straight line, the outer profile of the layers turns out to be linear as well, but in the disclosed invention it is necessary to shape suitably all the layers which face the ink feeding slot, so that their profile reproduces the saw-tooth outline.

A preliminary sand blasting phase is performed from the rear part of the wafer, to remove part of the material leaving a lesser thickness to ablate subsequently with the laser. Fiducial features placed on each chip enable a correct alignment, so that the trenches produced by the sand blasting turn out to be accurately overlapped to the slot regions.

After this phase, the actual laser ablation process is carried out. The same fiducials are used, to guarantee the precise correspondence of the machined regions in the layout. The laser beam travels both along the slot profile and inside a suitable adjacent internal stripe, to remove effectively the material at the slot area boundary, causing finally the internal plug to drop down. Focus correction could be necessary to optimize the process effectiveness, as far as the ablated depth increases. This can be obtained either with a suitable optics or changing the relative distance between the scan lens and the wafer surface.

When the beam trajectory is a straight line, there isn't a substantial difference between the nominal and the actual position on the laser spot during the movement. On the contrary (FIG. 33), in proximity of the turning points there can be appreciable deviations from the nominal trajectory, due to the scan head behavior. To compensate the resulting inaccuracy, alternating clockwise 51 and counterclockwise 52 laser beam movements around the slot profile 50 can lead to a better accuracy of the machined features, compensating possible errors in the laser spot position due to the scanning head. Sometimes, the terminal portions of the slot at the opposite sides of the longitudinal axis can require an additional ablation step, because the debris removal is less efficient at the extremity than in the center, due to the narrowness of the region, which is closed at three sides. Nevertheless, this additional ablation is generally very quick and it increases just slightly the total processing time.

The described process allows machining edge-shaped holes and, particularly, saw-tooth shaped feeding slots with good accuracy, high yield and repeatability and moderate processing time, implementing the required fluidic circuit to produce a high frequency print head.

The invention claimed is:

1. A method for manufacturing a thermal inkjet print head comprising the steps of providing resistors onto a substrate according to a staggered pattern, forming a fluid feed channel through the substrate so that the channel extends substantially orthogonal to the chip surface and having staggered edges that follow the staggered pattern of the resistors so that a fluid path length between a resistor edge and a corresponding staggered edge is substantially similar for each resistor, wherein the fluid channel is formed by sandblasting starting from the rear side of the substrate without reaching the opposite surface, and subsequent laser ablation to a through-slot, wherein the subsequent laser ablation is carried out starting from the rear side of the substrate.

2. The method according to claim 1, wherein the laser ablation is performed on the perimeter.

3. The method according to claim 1, wherein the laser ablation is performed on the entire slot surface.

4. The method according to claim 1, wherein the laser ablation is performed on an enlarged perimeter.

5. The method according to claim 1, wherein the laser ablation is performed by alternating movements of the laser beam clockwise and counterclockwise.

6. A thermal inkjet print head produced by the method according to claim 1.

* * * * *